US007132229B2

(12) United States Patent
Fukui

(10) Patent No.: US 7,132,229 B2
(45) **Date of Patent: *Nov. 7, 2006**

(54) PHOTOTHERMOGRAPHIC MATERIAL AND IMAGE FORMING METHOD

(75) Inventor: Kouta Fukui, Kanagawa (JP)

(73) Assignee: Fuji Photo Film Co., Ltd, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/179,766

(22) Filed: Jul. 13, 2005

(65) Prior Publication Data

US 2006/0019207 A1 Jan. 26, 2006

(30) Foreign Application Priority Data

Jul. 21, 2004 (JP) ..... 2004-213362
Jun. 6, 2005 (JP) ..... 2005-165902

(51) Int. Cl.
*G03C 1/00* (2006.01)

(52) U.S. Cl. ..... 430/619; 430/617; 430/618; 430/620; 430/964

(58) Field of Classification Search ..... 430/617–620, 430/964
See application file for complete search history.

(56) References Cited

U.S. PATENT DOCUMENTS

| | | | |
|---|---|---|---|
| 6,630,291 | B1 | 10/2003 | Maskasky et al. |
| 6,713,241 | B1 | 3/2004 | Vaeth et al. |
| 2004/0053173 | A1 | 3/2004 | Maskasky et al. |
| 2006/0057514 | A1 | 3/2006 | Nakagawa et al. |
| 2006/0057515 | A1 | 3/2006 | Mori et al. |

*Primary Examiner*—Geraldine Letscher
(74) *Attorney, Agent, or Firm*—Margaret A. Burke; Sheldon J. Moss

(57) ABSTRACT

A photothermographic material having an image forming layer containing at least a photosensitive silver halide, a non-photosensitive organic silver salt, a reducing agent, and a binder, and a non-photosensitive layer on at least one side of a support, in which the binder is a hydrophilic binder, the non-photosensitive layer contains gelatin or a gelatin derivative, the reducing agent is a compound represented by the following formula (R), and at least one compound represented by the following formula (I) or (II) is contained:

Formula (R)

(wherein in formula (R), $R^{11}$ and $R^{11'}$ each independently represent an alkyl group and at least one of $R^{11}$ and $R^{11'}$ is a secondary or tertiary alkyl group);

Formula (I)

(wherein in the formula (I), Q represents an atomic group necessary for forming a 5 or 6-membered imide ring); and Formula (II)

(wherein in the formula (II), $R_5$ independently represents a hydrogen atom or a substituent, r represents 0, 1, 2, 3 or 4, and X represents O, S, Se or $N(R_6)$). A photothermographic material that is excellent in coated surface state and has high image quality, and an image forming method are provided.

11 Claims, No Drawings

PHOTOTHERMOGRAPHIC MATERIAL AND IMAGE FORMING METHOD

CROSS-REFERENCE TO RELATED APPLICATION

This application claims priority under 35 USC 119 from Japanese Patent Application Nos. 2004-213362 and 2005-165902, the disclosures of which are incorporated by reference herein.

BACKGROUND OF THE INVENTION

1. Field of the Invention

The present invention relates to a photothermographic material and an image forming method using the same.

2. Description of the Related Art

In recent years, decreasing the amount of processing liquid waste in the field of films for medical imaging has been desired from the viewpoints of protecting the environment and economy of space. Technology is therefore required for photosensitive thermal developing image recording materials which can be imagewise exposed effectively by laser image setters or laser imagers, and thermally developed to obtain clear black-toned images of high resolution and sharpness, for use in medical diagnostic applications. An image forming system using photosensitive thermal developing image recording materials does not require liquid processing chemicals and can therefore be supplied to customers as a simpler and environmentally friendly system.

While similar requirements also exist in the field of general image forming materials, images for medical imaging in particular require high image quality excellent in sharpness and granularity because fine depiction is required, and further require blue-black image tone from the viewpoint of easy diagnosis. Various kinds of hard copy systems utilizing dyes or pigments, such as ink jet printers and electrophotographic systems, have been marketed as general image forming systems, but they are not satisfactory as output systems for medical images.

Photothermographic materials utilizing organic silver salts are described in many documents. Photothermographic materials generally have an image forming layer including catalytically active amounts of a photocatalyst (for example, silver halide), a reducing agent, a reducible silver salt (for example, an organic silver salt), and if necessary, a toner for controlling the color tone of developed silver images, dispersed in a binder. Photothermographic materials form black silver images by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region. The Fuji Medical Dry Imager FM-DPL is an example of a medical image forming system that has been made commercially available.

Methods of manufacturing such photothermographic material include a method of manufacture by a solvent coating, and a method of coating an aqueous coating solution using an aqueous dispersion of fine polymer particles or an aqueous solution of a water soluble polymer as a main binder followed by drying. Since the latter method does not require a process of solvent recovery or the like, a production facility therefor is simple, environmental burden is small, and the method is advantageous for mass production.

However, in the method of manufacturing the photothermographic material by an aqueous coating system, since the coating solution for the image forming layer contains many components required for image formation, there is a significant problem with regard to uniformly coating and drying the same. Particularly, in a case of coating a solution at a high speed and rapidly drying the same to prepare a photothermographic material in order to enhance productivity, there are various problems such as increase of haze due to partial lack of balance among the components in the coated layer and occurrence of unevenness in the coated surface state due to fluctuation of drying wind.

In U.S. Pat. Nos. 6,630,291 and 6,713,241, use of a hydrophilic binder such as gelatin as a binder is described; however, there are problems in that it is difficult to obtain a high image density and image color tone is poor due to a large amount of fogging.

In the photothermographic material, it is necessary that chemical components necessary for forming an image are contained in the film in advance. For this reason, these chemical components exert influences on storage stability of the photothermographic material up until it is used.

Further, even after an image has been formed by subjecting the photothermographic material to thermal development, since these chemical components remain in the film as unreacted components or reaction products, these chemical components exert influences on transparency of the film and the image color tone and, moreover, exert significant influences on the storage stability of the image. Therefore, it is desirable that the number of types and amounts of these chemical components are small, and it is further desirable that, although the chemical components have a high activity in an image forming reaction at the time of thermal development, they are inactive in storage; however, such requirements as described above have not sufficiently been satisfied so far, and improvement is required.

SUMMARY OF THE INVENTION

A first aspect of the invention is to provide a photothermographic material comprising, on at least one side of a support, an image forming layer comprising at least a photosensitive silver halide, a non-photosensitive organic silver salt, a reducing agent, and a binder, and a non-photosensitive layer, wherein 1) the binder is a hydrophilic binder;

2) the non-photosensitive layer comprises gelatin or a gelatin derivative;

3) the reducing agent is a compound represented by the following formula (R); and 4) the photothermographic material comprises at least one compound represented by the following formula (I) or (II):

Formula (R)

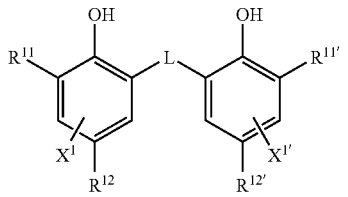

wherein in formula (R), $R^{11}$ and $R^{11'}$ each independently represent an alkyl group and at least one of $R^{11}$ and $R^{11'}$ is a secondary or tertiary alkyl group; $R^{12}$ and $R^{12'}$ each independently represent a hydrogen atom or a group capable of substituting for a hydrogen atom on a benzene ring; L represents an —S— group or a —$CHR^{13}$— group, wherein $R^{13}$ represents a hydrogen atom or an alkyl group; and $X^1$ and $X^{1'}$ each independently represent a hydrogen atom or a group capable of substituting for a hydrogen atom on a benzene ring;

Formula (I)

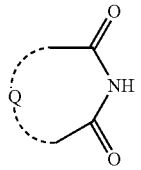

wherein in formula (I), Q represents an atomic group necessary for forming a 5- or 6-membered imide ring; and Formula (II)

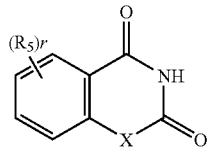

wherein in formula (II), $R_5$ independently represents one selected from a hydrogen atom, an alkyl group, a cycloalkyl group, an alkoxy group, an alkylthio group, an arylthio group, a hydroxyl group, a halogen atom, or an $N(R_8R_9)$ group, wherein $R_8$ and $R_9$ independently represent one selected from a hydrogen atom, an alkyl group, an aryl group, a cycloalkyl group, an alkenyl group, or a heterocyclic group; r represents 0, 1, 2, 3, or 4; $R_8$ and $R_9$ may link together to form a substituted or unsubstituted 5 to 7-membered heterocycle; two $R_5$'s may link together to form an aromatic, heteroaromatic, alicyclic, or heterocyclic condensed ring; and X represents one selected from O, S, Se, or $N(R_6)$, wherein $R_6$ represents one selected from a hydrogen atom, an alkyl group, an aryl group, a cycloalkyl group, an alkenyl group, or a heterocyclic group.

A second aspect of the invention is to provide an image forming method comprising: successively imagewise exposing and thermal developing the photothermographic material according to the first aspect at a line speed of 23 mm/second or higher.

DETAILED DESCRIPTION OF THE INVENTION

An object of the present invention is to provide a photothermographic material capable of obtaining an improved surface state and excellent image quality, and an image forming method using the same.

The present inventors have investigated new photothermographic material compositions capable of obtaining an excellent coated surface state and, as a result, found that the object of the invention cannot be attained by only replacing the binder in an image forming layer with a setting type hydrophilic binder such as gelatin. As a result of research by the present inventors, in cases where a hydrophilic binder is used, a new problem which has not existed at all in conventional silver halide photosensitive materials of wet developing type has been found.

As described above, although the photothermographic material contains all chemical agents necessary for forming an image in the film in advance, it has been found that when a hydrophilic binder is introduced, a specific interaction with the chemical agents occurs and, as a result, a local thickening or agglomeration of a coating solution is generated to cause a new coating unevenness. In order to solve such problems as described above, the present inventors have conducted intensive studies and, as a result, have achieved the invention.

The present invention is explained below in detail.

(Non-Photosensitive Organic Silver Salt)

1) Composition

The non-photosensitive organic silver salt which can be used in the present invention is relatively stable to light but serves as to supply silver ions and forms silver images when heated to 80° C. or higher in the presence of an exposed photosensitive silver halide and a reducing agent. The non-photosensitive organic silver salt may be any material containing a source capable of supplying silver ions that are reducible by a reducing agent.

Such a non-photosensitive organic silver salt is disclosed, for example, in Japanese Patent Application Laid-Open (JP-A) No. 10-62899 (paragraph Nos. 0048 to 0049), European Patent (EP) No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of long chained aliphatic carboxylic acid (having 10 to 30 carbon atoms, and preferably having 15 to 28 carbon atoms) is preferable. Preferred examples of the silver salt of fatty acid can include, for example, silver lignocerate, silver behenate, silver arachidinate, silver stearate, silver oleate, silver laurate, silver capronate, silver myristate, silver palmitate, silver erucate, and mixtures thereof.

In the invention, among these silver salts of fatty acid, it is preferred to use a silver salt of fatty acid with a silver behenate content of 40 mol % or higher, more preferably, 85 mol % or higher, and even more preferably, 95 mol % or higher. Further, it is preferred to use a silver salt of fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of organic acid includes silver arachidinate, it is preferred that the content of silver arachidinate is 6 mol % or lower in order to obtain a silver salt of organic acid having low fog and excellent image storability. The content of silver arachidinate is more preferably 3 mol % or lower.

2) Shape

There is no particular restriction on the shape of the organic silver salt usable in the invention and it may be needle-like, bar-like, tabular, or flake shaped.

In the invention, a flake shaped organic silver salt is preferred. Short needle-like, rectangular, cuboidal, or potato-like indefinite shaped particles with the major axis to minor axis ratio being 5 or less are also used preferably. Such organic silver particles suffer less from fogging during thermal development compared with long needle-like particles with the major axis to minor axis length ratio of more than 5. Particularly, a particle with the major axis to minor axis ratio of 3 or less is preferred since it can improve the mechanical stability of the coating film.

In the present specification, the flake shaped organic silver salt is defined as described below. When an organic silver salt is observed under an electron microscope, calculation is made while approximating the shape of an organic silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a major plane with b and c being as the sides. a in average is preferably 0.01 μm to 0.3 μm and, more preferably, 0.1 μm to 0.23 μm. c/b in average is preferably from 1 to 9, more preferably from 1 to 6, even more preferably from 1 to 4 and, most preferably 1 to 3.

By controlling the equivalent spherical diameter to 0.03 μm to 1 μm, it causes less agglomeration in the photothermographic material and image storability is improved. The equivalent spherical diameter is preferably from 0.05 μm to 0.8 μm, and particularly preferably from 0.08 μm to 0.2 μm. In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake particle is preferably from 1.1 to 30 and, more preferably, from 1.1 to 15 with a viewpoint of causing less agglomeration in the photothermographic material and improving the image storability.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, even more preferably, 50% or less. The shape of the organic silver salt can be measured by analyzing a dispersion of an organic silver salt as transmission type electron microscopic images.

Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, even more preferably, 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

The organic silver salt used for the present invention is preferably prepared in the presence of a compound represented by the following formulae (W1) or (W2).

The compound may be added at the time of the preparing process of organic silver salt, or at the dispersing process.

Formula (W1)

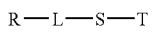

Formula (W2)

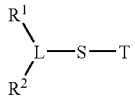

In the formulae, R represents a hydrophobic group, and at least one of $R^1$ and $R^2$ is a hydrophobic group. L represents a linking group. T represents an oligomer part, and L (linking group) and T (oligomer part) combine with thio bond (—S—). In case of formula (W1), L is not an essential group.

The number of the hydrophobic group is determined by the linking group L. The hydrophobic group is a group selected from a saturated or unsaturated alkyl group, an arylalkyl group, or an alkylaryl group, where each alkyl group may be linear or branched. Preferably, the hydrophobic R, $R_1$, and $R_2$ each have 8 to 21 carbon atoms. The compound represented by formula (W1) is preferably a compound represented by the following formulae (Wa), (Wb), or (Wc).

Formula (Wa)

Formula (Wb)

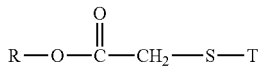

Formula (Wc)

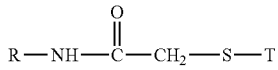

The representative compound represented by formula (W2) is preferably a compound represented by the following formulae (Wd), (We), or (Wf).

Formula(Wd)

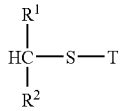

Formula(We)

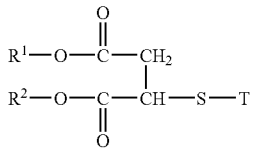

-continued

Formula(Wf)

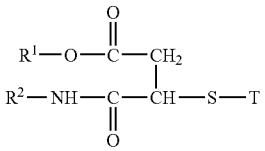

The oligomer part T is base on an oligomer derived from a vinyl monomer having an amide group and is polymerized at the vinyl part, and after forming the oligomer, the amide part becomes a non-ionic polar group which compose a hydrophilic group. The oligomer part T may be a copolymerized oligomer composed by one or plural monomers.

Specific examples of the monomer used for forming the oligomer part T include an acrylamide, a methacrylamide, an acrylamide derivative, a methacrylamide derivative, and 2-vinyl pyrrolidone.

These monomers can be expressed by the following formulae.

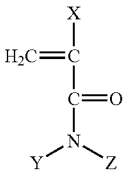

Acrylamide or a derivative thereof, methacrylamide or a derivative thereof

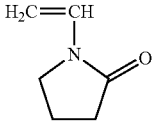

2-Vinylpyrrolidone

In the formulae, X represents a hydrogen atom or an alkyl group having 1 to 10 carbon atoms. X is preferably a hydrogen atom or a methyl group. Y and Z each independently represent a hydrogen atom, an alkyl group having 1 to 10 carbon atoms, a substituted alkyl group having 1 to 10 carbon atoms. Y and Z are preferably a hydrogen atom, a methyl group, an ethyl group, or —$C(CH_2OH)_3$ group. X and Y may be the same or different from each other.

The number of repeating units of the oligomer part T is 20 or less, preferably from 5 to 15.

Examples of the compound represented by formula (W1) or (W2) for use in the present invention are set forth below, however, the present invention is not limited to these.

BUN-1

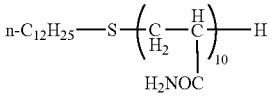

BUN-2

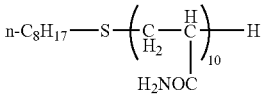

BUN-3

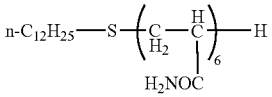

-continued

BUN-4

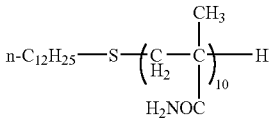

BUN-5

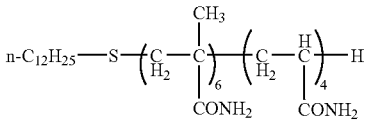

BUN-6

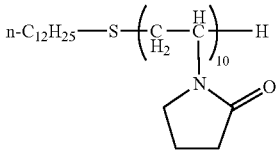

BUN-7

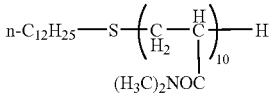

BUN-8

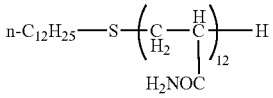

BUN-9

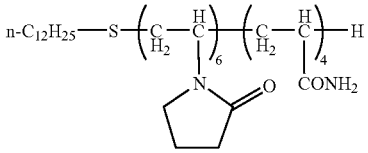

BUN-10

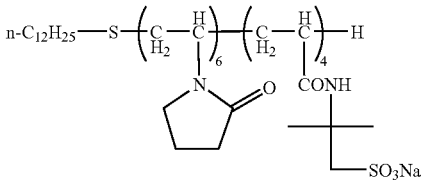

The compound represented by formula (W1) or (W2) which is obtained from a vinyl polymer having the said amide group is an oligomer surfactant. The oligomer surfactant can be produced by well-known methods in the art. One example of the synthesis method is described in Example mentioned hereinafter.

The method of preparing an aqueous nano-particle dispersion of silver carboxylate comprises dispersion steps of:

(A) forming a slurry by mixing silver carboxylate, carboxylic acid, an alkali metal salt of carboxylic acid, water, and the compound represented by formulae (W1), or (W2), (B) mixing the obtained slurry with zirconia beads having a mean particle diameter of 0.5 mm or less, (C) adding the mixture of step (B) into a high speed mill, (D) dispersing the mixture of step (C) until reaching the particle diameter distribution of silver carboxylate in which 90% by weight of the silver carboxylate particle has a particle diameter of less than 1 μm, and (E) separating the used beads from the slurry dispersed in step (D).

When a photosensitive silver salt is present together during dispersion of the organic silver salt, fog increases and sensitivity becomes remarkably lower, so that it is more preferred that the photosensitive silver salt is not substantially contained during dispersion.

In the invention, the amount of the photosensitive silver salt to be disposed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably, from 2 mol % to 20 mol % and, particularly preferably, 3 mol % to 15 mol %. A method of mixing two or more kinds of aqueous dispersions of organic silver salts and two or more kinds of aqueous dispersions of photosensitive silver salts upon mixing is used preferably for controlling the photographic properties.

4) Addition Amount

While an organic silver salt in the invention can be used in a desired amount, a total amount of coated silver including silver halide is preferably in a range of from 0.1 $g/m^2$ to 5.0 $g/m^2$, more preferably from 0.3 $g/m^2$ to 3.0 $g/m^2$, and even more preferably from 0.5 $g/m^2$ to 2.0 $g/m^2$.

Particularly, in order to improve image storability, the total amount of coated silver is preferably 1.8 $mg/m^2$ or less, more preferably 1.6 $mg/m^2$ or less.

In the case where a preferable reducing agent in the invention is used, it is possible to obtain a sufficient image density by even such a low amount of silver.

(Reducing Agent)

The photothermographic material of the present invention contains a reducing agent for organic silver salts as a thermal developing agent.

The reducing agent according to the invention is preferably a so-called hindered phenolic reducing agent or a bisphenol agent having a substituent at the ortho-position to the phenolic hydroxy group. It is more preferably a reducing agent represented by the following formula (R).

Formula (R)

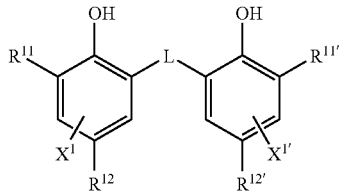

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Formula (R) is to be described in detail.

In the following description, when referred to as an alkyl group, it means that the alkyl group contains a cycloalkyl group, as far as it is not mentioned specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring. $X^1$ and $X^{1'}$ each independently represent a hydrogen atom or a group capable of substituting for a hydrogen atom on a benzene ring. As each of the groups capable of substituting for a hydrogen atom on the benzene ring, an alkyl group, an aryl group, a halogen atom, an alkoxy group, and an acylamino group are described preferably.

3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group can include, similar to the substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a secondary or tertiary alkyl group having 3 to 15 carbon atoms. Specifically, an isopropyl group, a t-butyl group, a t-amyl group, a t-octyl group, a cyclohexyl group, a cyclopentyl group, a 1-methylcyclohexyl group, a 1-methylcyclopropyl group, and the like can be described. $R^{11}$ and $R^{11'}$ each represent, more preferably, a t-butyl group, a t-amyl group, or a 1-methylcyclohexyl group and a t-butyl group being most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms. The alkyl group is preferably a chain or a cyclic alkyl group.

And, a group which has a C═C bond in these alkyl group is also preferably used. Preferable examples of the alkyl group can include a methyl group, an ethyl group, a propyl group, an isopropyl group, a 2,4,4-trimethylpentyl group, a cyclohexyl group, a 2,4-dimethyl-3-cyclohexenyl group, a 3,5-dimetyl-3-cyclohexenyl group and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ is preferably a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are a tertiary alkyl group and $R^{12}$ and $R^{12'}$ are an alkyl group other than a methyl group, $R^{13}$ is preferably a hydrogen atom.

In the case where $R^{11}$ and $R^{11'}$ are not a tertiary alkyl group, $R^{13}$ is preferably a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal development performances, color tones of developed silver images, or the like depending on the combination of $R^{11}$, $R^{11'}$, $R^{12}$, $R^{12'}$, and $R^{13}$. Since these performances can be controlled by using two or more kinds of reducing agents at various mixing ratios, it is preferred to use two or more kinds of reducing agents in combination depending on the purpose.

Specific examples of the reducing agents of the invention including the compounds represented by formula (R) according to the invention are shown below, but the invention is not restricted to these.

R1-1

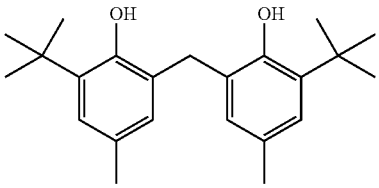

R1-2

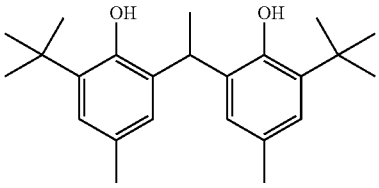

R1-3

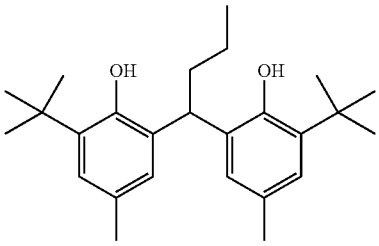

-continued

R1-4

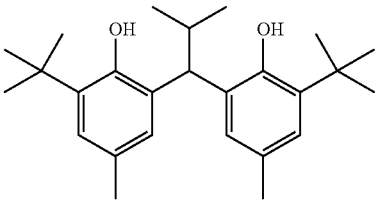

R1-5

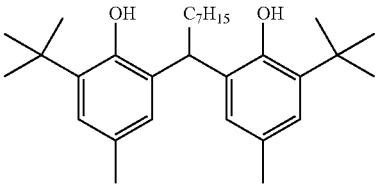

R1-6

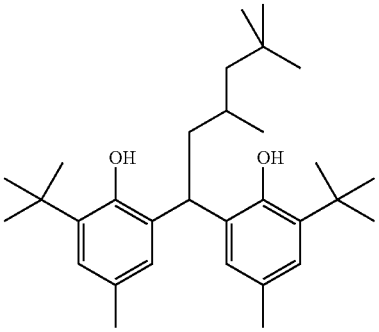

R1-7

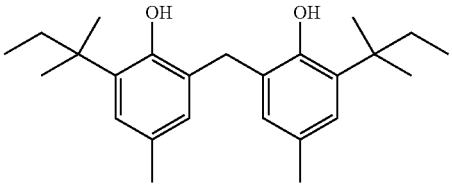

R1-8

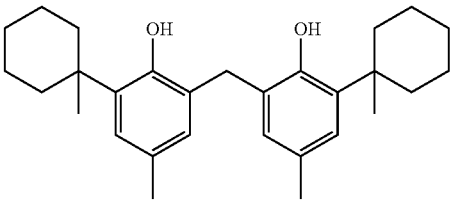

R1-9

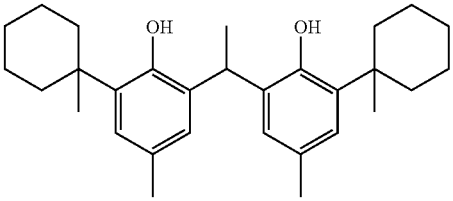

R1-10

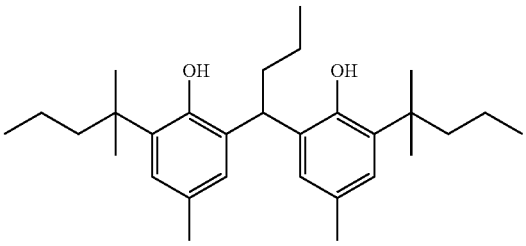

-continued
R1-11
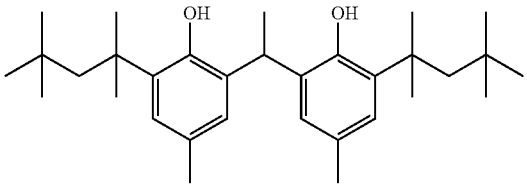
R1-12
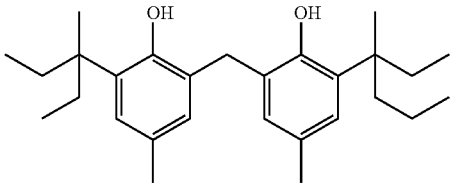
R1-13
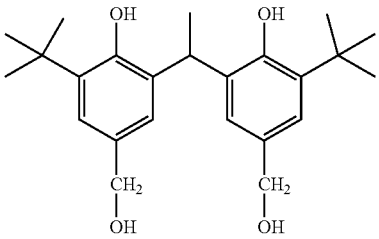
R1-14
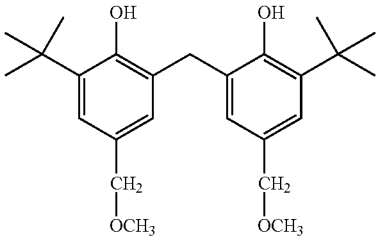
R1-15
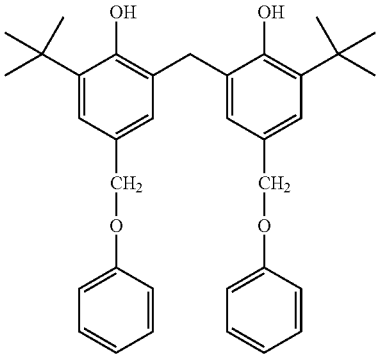
R1-16
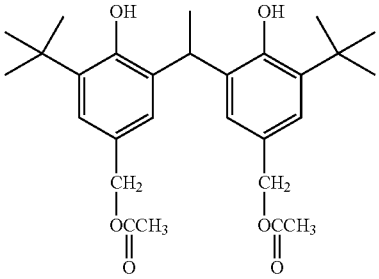
-continued
R1-17
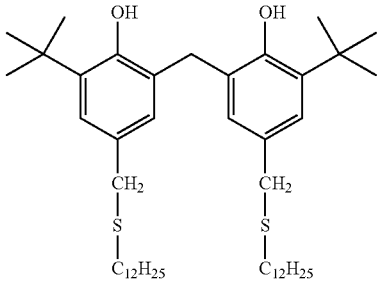
R1-18
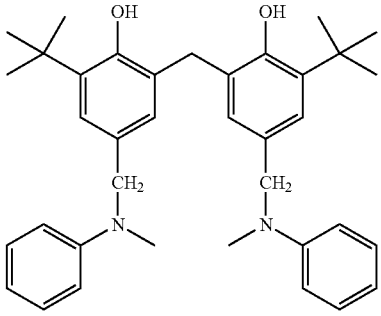
R1-19
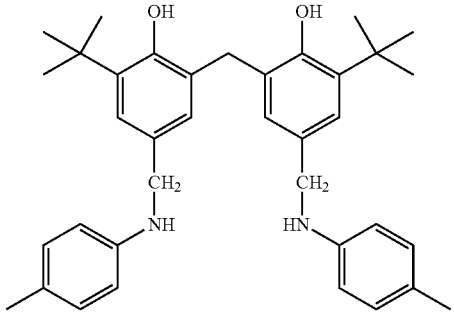
R1-20
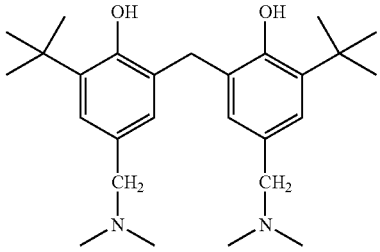
R1-21
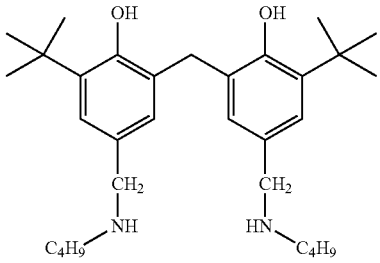

-continued
R1-22
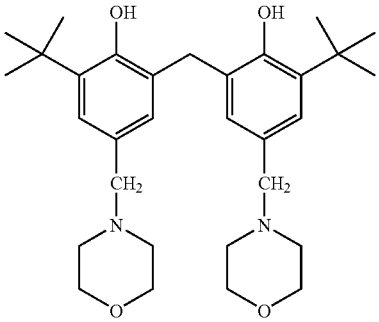
R1-23
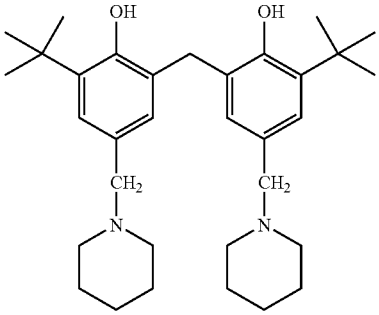
R1-24
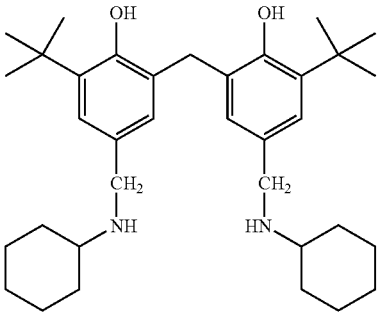
R1-25
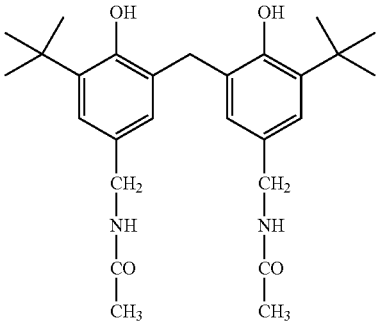
R1-26
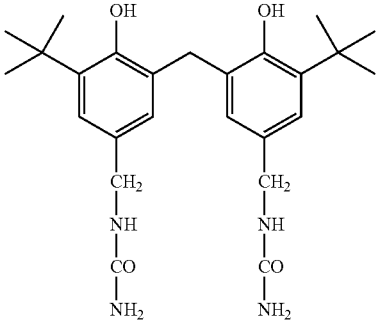
-continued
R1-27
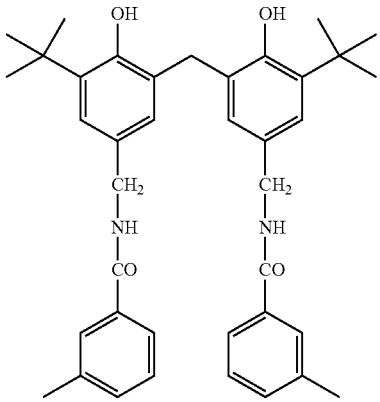
R1-28
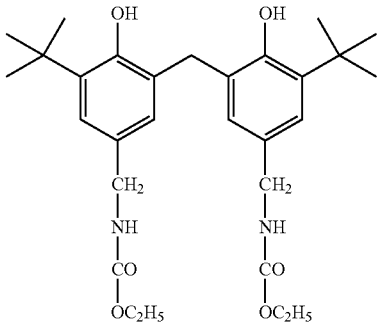
R1-29
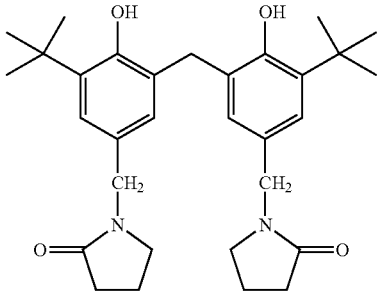
R1-30
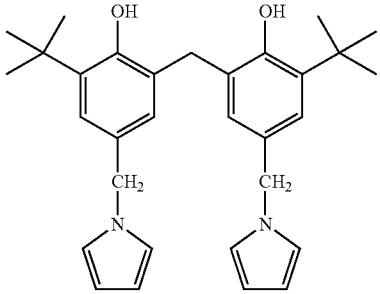

-continued

R1-31

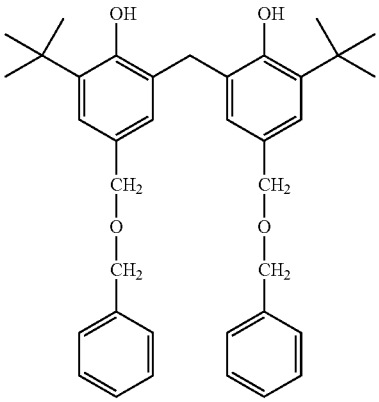

R1-32

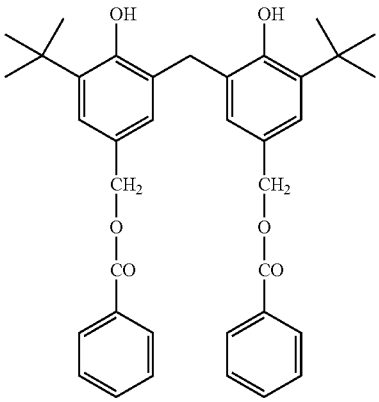

R1-33

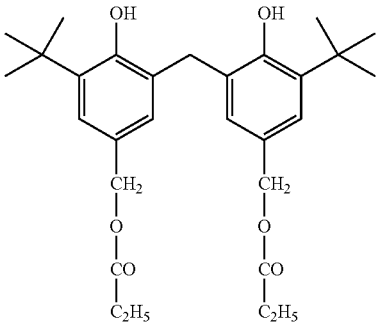

R1-34

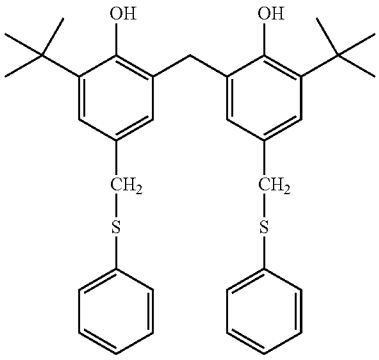

-continued

R1-35

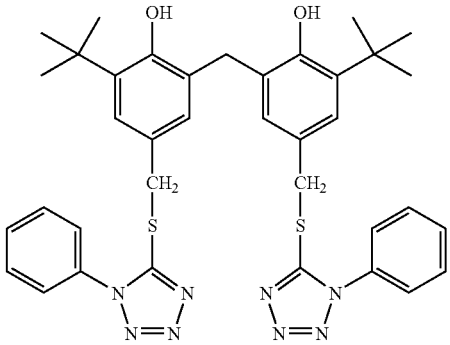

R1-36

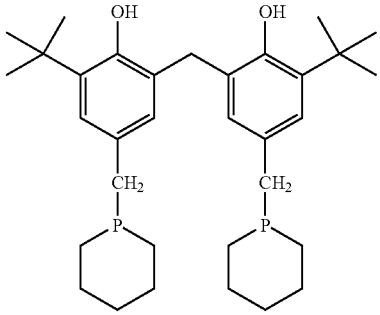

As preferred reducing agents of the invention other than those above, there can be mentioned compounds disclosed in JP-A Nos. 2001-188314, 2001-209145, 2001-350235, and 2002-156727, and EP No. 1278101A2.

The addition amount of the reducing agent is preferably from 0.1 g/m$^2$ to 3.0 g/m$^2$, more preferably from 0.2 g/m$^2$ to 2.0 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer.

The reducing agent can be added to any layer on the side having thereon the image forming layer. The reducing agent is preferably contained in the image forming layer.

In the invention, the reducing agent may be incorporated into photothermographic material by being added into the coating solution, such as in the form of solution, emulsion dispersion, solid fine particle dispersion, or the like.

As well known emulsion dispersing method, there can be mentioned a method comprising dissolving the reducing agent in an oil such as dibutylphthalate, tricresylphosphate, dioctylsebacate, tri(2-ethylhexyl)phosphate, or the like, and an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsion dispersion is mechanically produced. During the process, for the purpose of controlling viscosity of oil droplet and refractive index, the addition of polymer such as α-methylstyrene oligomer, poly(t-butylacrylamide), or the like is preferable.

As solid fine particle dispersing method, there can be mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining solid dispersion.

In this case, there may also be used a protective colloid (such as poly(vinyl alcohol)), or a surfactant (for instance, an anionic surfactant such as sodium triisopropylnaphthalenesulfonate (a mixture of compounds having the isopropyl groups in different substitution sites)).

In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in the aqueous dispersion.

The reducing agent is particularly preferably used as a solid particle dispersion, and the reducing agent is added in the form of fine particles having mean particle size from 0.01 μm to 10 μm, and more preferably, from 0.05 μm to 5 μm, and even more preferably, from 0.1 μm to 2 μm.

In the invention, other solid dispersions are preferably used with this particle size range.

(Development Accelerator)

In the photothermographic material of the invention, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator.

Further, phenolic compounds described in JP-A Nos. 2002-311533 and 2002-341484 are also preferable. Naphthalic compounds described in JP-A No. 2003-66558 are particularly preferable.

The development accelerator described above is used in a range of from 0.1 mol % to 20 mol %, preferably, in a range of from 0.5 mol % to 10 mol % and, more preferably in a range of from 1 mol % to 5 mol %, with respect to the reducing agent.

The introducing methods to the photothermographic material can include similar methods as those for the reducing agent and, it is particularly preferred to add as a solid dispersion or an emulsion dispersion. In the case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, among the development accelerators described above, it is more preferred to use hydrazine compounds described in the specification of JP-A Nos. 2002-156727 and 2002-278017, and naphtholic compounds described in the specification of JP-A No. 2003-66558.

Particularly preferred development accelerators of the invention are compounds represented by the following formulae (A-1) or (A-2).

Formula (A-1)

$$Q_1—NHNH—Q_2$$

wherein $Q_1$ represents an aromatic group or a heterocyclic group which bonds to —NHNH—$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5 to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in a case where they have two or more substituents, the substituents may be identical or different from each other. Examples of the substituents can include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents can include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms and, more preferably having 6 to 40 carbon atoms, and examples can include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl) carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbamoyl, N-3-pyridylcarbamoyl, and N-benzylcarbamoyl.

The acyl group represented by $Q_2$ is an acyl group, preferably having 1 to 50 carbon atoms and, more preferably having 6 to 40 carbon atoms, and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl.

The alkoxycarbonyl group represented by $Q_2$ is an alkoxycarbonyl group, preferably having 2 to 50 carbon atoms and, more preferably having 6 to 40 carbon atoms, and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group, preferably having 7 to 50 carbon atoms and, more preferably having 7 to 40 carbon atoms, and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably having 6 to 40 carbon atoms, and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl.

The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different from each other.

Next, preferred range for the compound represented by formula (A-1) is to be described. A 5 or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated hetero ring are more preferred.

Further, $Q_2$ is preferably a carbamoyl group and, particularly, a carbamoyl group having a hydrogen atom on the nitrogen atom is particularly preferred.

Formula (A-2)

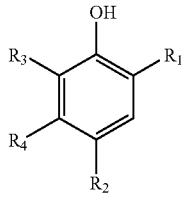

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group capable of substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

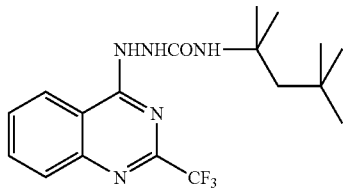

A-2

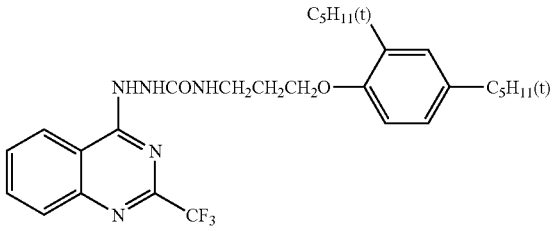

A-3

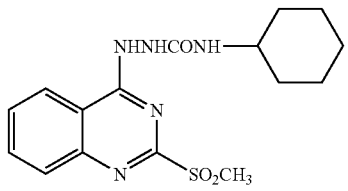

-continued

A-4

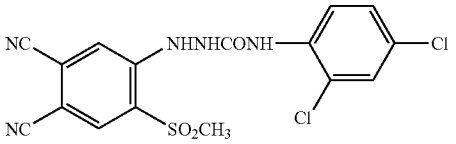

A-5

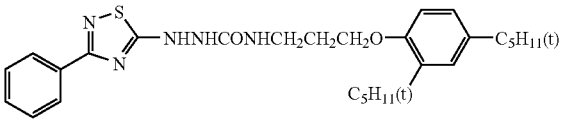

A-6

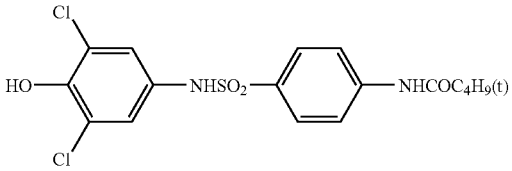

A-7

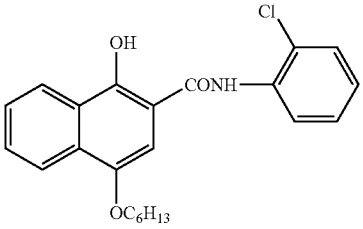

A-8

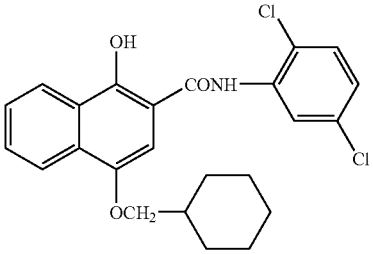

A-9

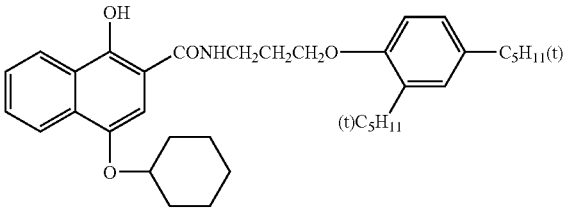

A-10

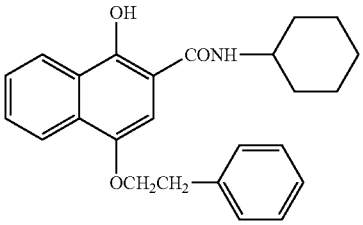

-continued

A-11

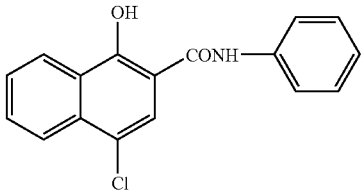

A-12

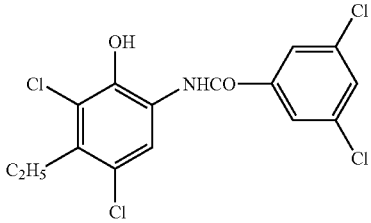

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxyl group or an amino group, there can be mentioned a phosphoryl group, a sulfoxide group, a sulfonyl group, a carbonyl group, an amide group, an ester group, an urethane group, an ureido group, a tertiary amino group, a nitrogen-containing aromatic group, and the like. Particularly preferred among them is a phosphoryl group, a sulfoxide group, an amide group (not having >N—H moiety but being blocked in the form of >N—Ra (where, Ra represents a substituent other than H)), an urethane group (not having >N—H moiety but being blocked in the form of >N—Ra (where, Ra represents a substituent other than H)), and an ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

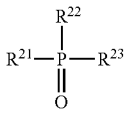

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ is an alkyl group, an aryl group, an alkoxy group, or an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

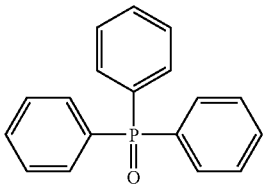

D-2

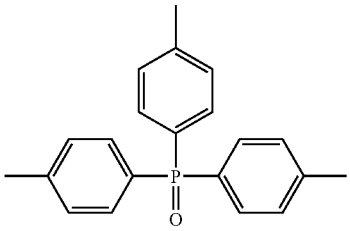

-continued

D-3

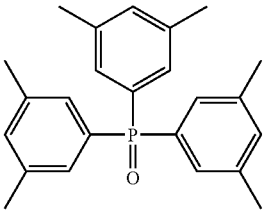

D-4

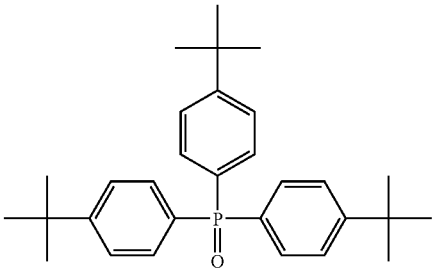

D-5

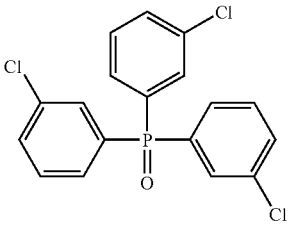

D-6

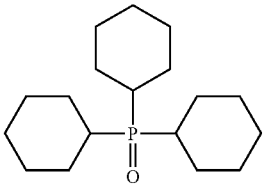

D-7

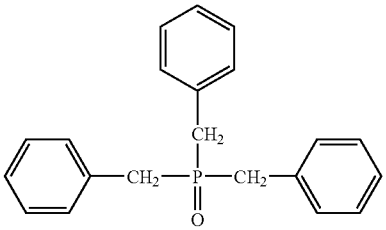

D-8

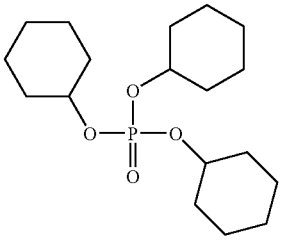

D-9

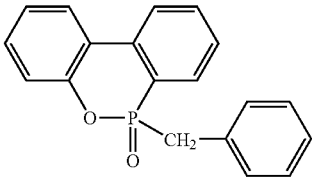

-continued

D-10

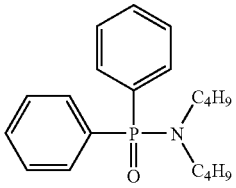

D-11

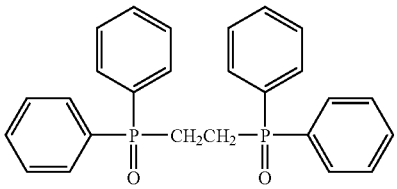

D-12

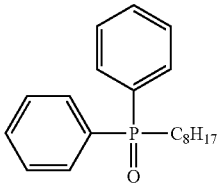

D-13

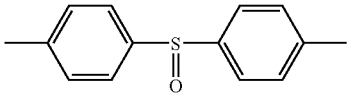

D-14

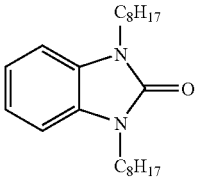

D-15

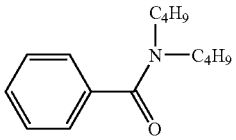

Specific examples of hydrogen bonding compounds other than those enumerated above can be found in those described in EP No. 1,096,310 and in JP-A Nos. 2002-156727 and 2002-318431.

The compound expressed by formula (D) used in the invention can be used in the photothermographic material by being incorporated into the coating solution in the form of solution, emulsion dispersion, or solid fine particle dispersion, similar to the case of reducing agent. However, it is preferably used in the form of solid dispersion. In the solution, the compound expressed by formula (D) forms a hydrogen-bonded complex with a compound having a phenolic hydroxyl group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to 200 mol %, more preferably from 10 mol % to 150 mol %, and even more preferably, from 20 mol % to 100 mol %, with respect to the reducing agent.

(Photosensitive Silver Halide)

1) Halogen Composition

For the photosensitive silver halide used in the invention, there is no particular restriction on the halogen composition and silver chloride, silver bromochloride, silver bromide, silver iodobromide, silver iodochlorobromide, and silver iodide can be used. Among them, silver bromide, silver iodobromide, and silver iodide are preferred. The distribution of the halogen composition in a grain may be uniform or the halogen composition may be changed stepwise, or it may be changed continuously.

Further, a silver halide grain having a core/shell structure can be used preferably. Preferred structure is a twofold to fivefold structure and, more preferably, core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, from 0.01 μm to 0.15 μm and, even more preferably, from 0.02 μm to 0.12 μm. The grain size as used herein means an average diameter of a circle converted such that it has a same area as a projected area of the silver halide grain (projected area of a major plane in a case of a tabular grain).

4) Grain Shape

The shape of the silver halide grain can include, for example, cubic, octahedral, tabular, spherical, rod-like, or potato-like shape. The cubic grain is particularly preferred in the invention. A silver halide grain rounded at corners can also be used preferably.

The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or more, more preferably, 65% or more and, even more preferably, 80% or more. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

5) Heavy Metal

The photosensitive silver halide grain of the invention can contain metals or complexes of metals belonging to groups 6 to 13 of the periodic table (showing groups 1 to 18). Preferred are metals or complexes of metals belonging to groups 6 to 10. The metal or the center metal of the metal complex from groups 6 to 10 of the periodic table is preferably rhodium, ruthenium, iridium, or ferrum. The metal complex may be used alone, or two or more kinds of complexes comprising identical or different species of metals may be used together.

A preferred content is in a range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$.

In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. Phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to the spectral characteristic of an exposure light source can be advantageously selected. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (1) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 0803764A1, and in JP-A Nos. 2001-272747, 2001-290238 and 2002-23306.

The sensitizing dyes described above may be used alone or two or more of them may be used in combination.

In the invention, sensitizing dye can be added preferably after a desalting step and before coating, and more preferably after a desalting step and before the completion of chemical ripening.

In the invention, the sensitizing dye may be added at any amount according to the property of sensitivity and fogging, but it is preferably added from $10^{-6}$ mol to 1 mol, and more preferably from $10^{-4}$ mol to $10^{-1}$ mol, per 1 mol of silver halide in the image forming layer.

The photothermographic material of the invention may also contain super sensitizers in order to improve the spectral sensitizing effect.

The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

8) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The amount of sulfur, selenium, or tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol, per 1 mol of silver halide.

The addition amount of the gold sensitizer may vary depending on various conditions and it is generally from $10^{-7}$ mol to $10^{-3}$ mol and, preferably from $10^{-6}$ mol to $5\times10^{-4}$ mol, per 1 mol of silver halide.

There is no particular restriction on the condition for the chemical sensitization in the invention and, appropriately, the pH is from 5 to 8, the pAg is from 6 to 11, and the temperature is from 40° C. to 95° C.

In the silver halide emulsion used in the invention, a thiosulfonic acid compound may be added by the method shown in EP-A No. 293,917.

A reductive compound is used preferably for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred.

The reduction sensitizer may be added at any stage in the photosensitive emulsion producing process from crystal growth to the preparation step just before coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Combined Use of a Plurality of Silver Halides

The photosensitive silver halide emulsion in the photothermographic material used in the invention may be used alone, or two or more kinds of them (for example, those of different average particle sizes, different halogen compositions, of different crystal habits and of different conditions for chemical sensitization) may be used together.

Gradation can be controlled by using plural kinds of photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

10) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, even more preferably, from 0.07 $g/m^2$ to 0.3 $g/m^2$. The photosensitive silver halide is used in a range of from 0.01 mol to 0.5 mol, preferably, from 0.02 mol to 0.3 mol, and even more preferably from 0.03 mol to 0.2 mol, per 1 mol of the organic silver salt.

11) Mixing Photosensitive Silver Halide and Organic Silver Salt

The method of mixing the silver halide and the organic silver salt can include a method of mixing separately prepared photosensitive silver halide grains and organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above.

Further, a method of mixing two or more kinds of aqueous dispersions of organic silver salts and two or more kinds of aqueous dispersions of photosensitive silver salts upon mixing is used preferably for controlling the photographic properties.

12) Mixing Silver Halide into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Binder)

Any kind of polymer may be used as the binder for the image forming layer of the present invention so long as it is a hydrophilic binder. Suitable as the binder are those that are transparent or translucent, and that are generally colorless, such as natural resin or polymer and their copolymers; synthetic resin, or polymer and their copolymer; or media forming a film; for example included are gelatins, rubbers, poly(vinyl alcohols), hydroxylethyl celluloses, cellulose acetates, poly(vinyl pyrrolidones), casein, starch, poly (acrylic acids), and poly(methyl methacrylates).

In the present invention, 50% by weight or more of the binder used in the image forming layer is preferably formed by a hydrophilic binder, and particularly, 70% by weight or more of the binder of the image forming layer is preferably formed by a hydrophilic binder.

The specific examples of preferred hydrophilic binder include, but not limited to these examples, gelatin or gelatin derivatives (for example, alkali-processed gelatin, acid-processed gelatin, acetylated gelatin, oxidized gelatin, phthalated gelatin, or deionized gelatin), polysilicic acid, acrylamide/methacrylamide polymer, acrylate/methacrylate polymer, poly(vinyl pyrrolidones), poly(vinyl acetates), poly(vinyl alcohols), poly(vinyl lactams), polymer of sulfoalkyl acrylate, polymer of sulfoalkyl methacrylate, hydrolysised poly(vinyl acetate), polysaccarides (for example, dextrans, starch ethers, and the like), and the other substantially hydrophilic synthetic or natural vehicles (for example, referred to Research Disclosure, item 38957). Among them, more preferred binder are gelatin, a gelatin derivative, and a poly(vinyl alcohols), and most preferred are gelatin and a gelatin derivative.

In the invention, the image forming layer is preferably formed by first applying a coating solution containing 30% by weight or more of water in the solvent and by then drying, and particularly preferably applying a coating solution containing 50% by weight or more of water.

The aqueous solvent in which the polymer is soluble or dispersible, as referred herein, signifies water or water containing mixed therein 70% by weight or less of water-miscible organic solvent. As water-miscible organic solvents, there can be used, for example, alcohols such as methyl alcohol, ethyl alcohol, propyl alcohol, or the like; cellosolves such as methyl cellosolve, ethyl cellosolve, butyl cellosolve, or the like; ethyl acetate, dimethylformamide, or the like.

In the present invention, a hydrophobic binder may be used in combination with the hydrophilic binder. The hydrophobic binders which can be used in combination are preferably polymer latexes dispersed in an aqueous solvent. Preferred embodiment of these polymers includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like.

As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer.

The molecular weight of these polymers is, in number average molecular weight, in a range of from 5,000 to 1,000,000, and preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

Concerning the amount of the binder for the image forming layer according to the invention, the mass ratio of organic silver salt to total binder (organic silver salt/total binder) is preferably in a range of from 1/10 to 10/1, more preferably from 0.6 to 3.0, and even more preferably from 1.0 to 2.5.

The total amount of binder in the image forming layer of the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$.

Concerning the image forming layer of the invention, there may be added a crosslinking agent for crosslinking, a surfactant to improve coating properties, or the like.

In the invention, a solvent of a coating solution for the image forming layer in the photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate.

A water content in a solvent is more preferably 50% by weight or more, and even more preferably 70% by weight or more. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, U.S. Pat. No. 6,083,681, and EP No. 1,048,975.

1) Organic Polyhalogen Compound

Preferable organic polyhalogen compound that can be used in the invention is explained specifically below. In the invention, preferred organic polyhalogen compounds are the compounds expressed by the following formula (H).

Formula (H)

$$Q—(Y)n-C(X_1)(X_2)Z$$

In formula (H), Q represents one selected from an alkyl group, an aryl group, or a heterocyclic group; Y represents a divalent linking group; n represents 0 or 1; Z represents a halogen atom; and $X_1$ and $X_2$ each represent a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q preferably is a phenyl group substituted by an electron-attracting group whose Hammett substituent constant $\sigma p$ yields a positive value. For the details of Hammett substituent constant, reference can be made to Journal of Medicinal Chemistry, vol. 16, No. 11 (1973), pp. 1207 to 1216, and the like.

As such electron-attracting groups, examples include halogen atoms, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group, and the like. Preferable as the electron-attracting group are a halogen atom, a carbamoyl group, and an arylsulfonyl group, and particularly preferred is a carbamoyl group.

At least one of $X_1$ and $X_2$ is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

Z is preferably a bromine atom or an iodine atom, and more preferably, a bromine atom.

Y preferably represents —C(═O)—, —SO—, —$SO_2$—, —C(═O)N(R)—, or —$SO_2$N(R)—; more preferably, —C(═O)—, —$SO_2$—, or —C(═O)N(R)—; and particularly preferably, —$SO_2$— or —C(═O)N(R)—. Herein, R represents a hydrogen atom, an aryl group, or an alkyl group, preferably a hydrogen atom or an alkyl group, and particularly preferably a hydrogen atom.

n represents 0 or 1, and preferably represents 1.

In formula (H), in the case where Q is an alkyl group, Y is preferably —C(═O)N(R)—. And, in the case where Q is an aryl group or a heterocyclic group, Y is preferably —$SO_2$—.

In formula (H), the form where the residues, which are obtained by removing a hydrogen atom from the compound, bind to each other (generally called bis type, tris type, or tetrakis type) is also preferably used.

In formula (H), the form having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonium group, a pyridinium group, or the like), a polyethyleneoxy group, a hydroxy group, or the like is also preferable.

Specific examples of the compound expressed by formula (H) of the invention are shown below.

H-1

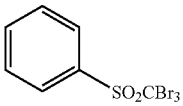

H-2

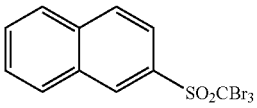

H-3

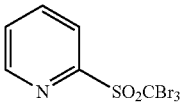

H-4

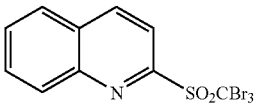

H-5

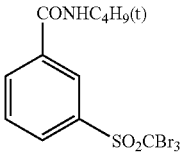

H-6

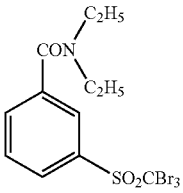

-continued

H-7

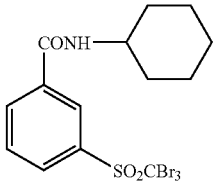

H-8

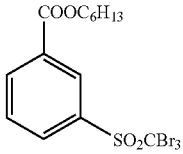

H-9

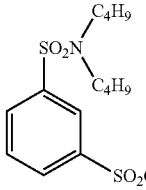

H-10

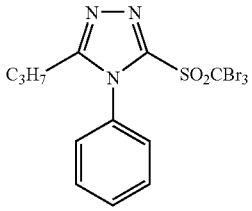

H-11

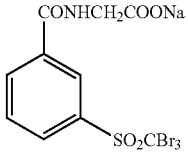

H-12

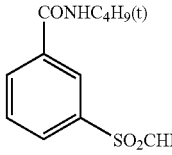

H-13

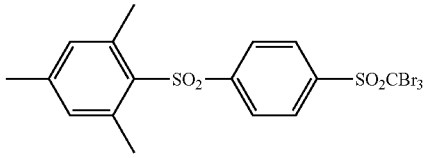

H-14

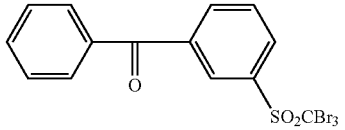

H-15

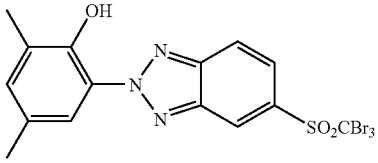

-continued

H-16

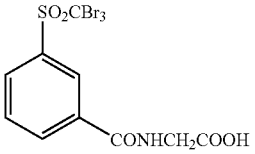

H-17

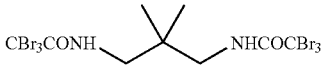

H-18

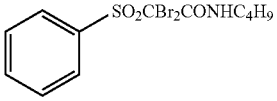

H-19

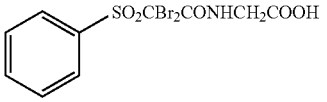

H-20

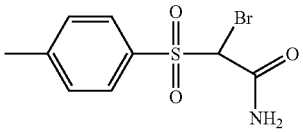

H-21

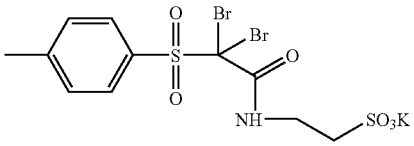

As preferred organic polyhalogen compounds of the invention other than those above, there can be mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, compounds disclosed in JP-A Nos. 7-2781, 2001-33911 and 20001-312027 are preferable.

The compounds expressed by formula (H) of the invention are preferably used in an amount from $10^{-4}$ mol to 1 mol, more preferably, from $10^{-3}$ mol to 0.5 mol, and even more preferably, from $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound expressed by formula (XI) described in JP-A No. 59-193447, a compound described in Japanese Patent Application Publication (JP-B) No. 55-12581, and a compound expressed by formula (II) in JP-A No. 60-153039. The azolium salt may be added to any part of the photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating.

As the method for adding the azolium salt, any method using a powder, a solution, a fine-particle dispersion, and the like, may be used. Furthermore, it may be added as a solution having mixed therein other additives such as sensitizing agents, reducing agents, toners, and the like.

In the invention, the azolium salt may be added at any amount, but preferably, it is added in a range from $1\times10^{-6}$ mol to 2 mol, and more preferably, from $1\times10^{-3}$ mol to 0.5 mol, per 1 mol of silver.

(Compound of Formula (I) or (II))

Formula (I)

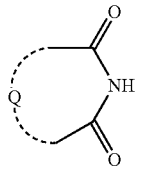

Formula (II)

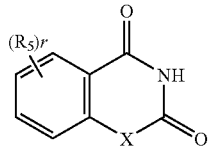

In formula (I), Q represents an atomic group necessary for forming a 5 or 6-membered imide ring. In formula (II), $R_5$ independently represents one or more hydrogen atoms, an alkyl group, a cycloalkyl group, an alkoxy group, an alkylthio group, an arylthio group, a hydroxy group, a halogen atom, or an $N(R_8R_9)$ group. Two $R_5$s may link together to form an aromatic, heteroaromatic, alicyclic, or heterocyclic condensed ring. Herein, $R_8$ and $R_9$ each independently represent a hydrogen atom, an alkyl group, an aryl group, a cycloalkyl group, an alkenyl group, or a heterocyclic group, or $R_8$ and $R_9$ can link together and represent an atomic group necessary for forming a substituted or unsubstituted 5 to 7-membered heterocycle. X represents O, S, Se or $N(R_6)$ and $R_6$ represents a hydrogen atom, an alkyl group, an aryl group, a cycloalkyl group, or a heterocyclic group. r represents 0, 1, 2, 3, or 4.

1) Formula (I)

The nitrogen atom and the carbon atom which composes Q may bind with a hydrogen atom, an amino group, an alkyl group having 1 to 4 carbon atoms, a halogen atom, a keto-formed oxygen atom, an aryl group, or the like as a branch. As the specific example of the compound having an imide ring represented by formula (I), uracil, 5-bromouracil, 4-methyluracil, 5-methyluracil, 4-carboxyuracil, 4,5-dimethyluracil, 5-aminouracil, dihydrouracil, 1-ethyl-6-methyluracil, 5-carboxymethylaminouracil, barbituric acid, 5-phenylbarbituric acid, cyanuric acid, urazole, hydantoin, 5,5-dimethylhydantoin, gultarimide, glutaconimide, citrazic acid, succinimide, 3,4-dimethylsuccinimide, maleimide, phthalimide, naphthalimide, and the like are described, but the examples are not limited in these. In the present invention, among the compounds having an imide ring represented by formula (I), succinimide, phthalimide, naphthalimide, and 3,4-dimethylsuccinimide are preferred, and succinimide is particularly preferred.

2) Formula (II)

In formula (II), $R_5$ independently represents one or more hydrogen atoms, an alkyl group, a cycloalkyl group, an alkoxy group, an alkylthio group, an arylthio group, a hydroxy group, a halogen atom, or an $N(R_8R_9)$ group. Furthermore, two $R_5$s may link together to form an aromatic, heteroaromatic, alicyclic, or heterocyclic condensed ring. In the case where $R_5$ represents an amino group $[(R_8R_9)]$, $R_8$ and $R_9$ each independently represent a hydrogen atom, an alkyl group, an aryl group, a cycloalkyl group, an alkenyl group, or a heterocyclic group.

Furthermore, $R_8$ and $R_9$ can link together and represent an atomic group necessary for forming a substituted or unsubstituted 5 to 7-membered heterocycle. In formula (II), X represents O, S, Se, or $N(R_6)$ and $R_6$ represents a hydrogen atom, an alkyl group, an aryl group, a cycloalkyl group, an alkenyl group, or a heterocyclic group. r represents 0, 1, 2, 3, or 4.

Useful alkyl group as $R_5$, $R_6$, $R_8$, or $R_9$ is linear, branched, or cyclic one and can have 1 to 20 carbon atoms, and has preferaby 1 to 5 carbon atoms. The alkyl group having 1 to 4 carbon atoms (e.g., methyl, ethyl, iso-propyl, n-butyl, t-butyl, or sec-butyl) is particularly preferable.

Useful aryl group as $R_5$, $R_6$, $R_8$, or $R_9$ can have 6 to 14 carbon atoms in an aromatic ring (one or plural). Preferred aryl group are a phenyl group and a substituted phenyl group.

Useful cycloalkyl group as $R_5$, $R_6$, $R_8$, or $R_9$ can have 5 to 14 carbon atoms in a center ring system. Preferred cycloalkyl group are cyclopentyl and cyclohexyl.

Useful alkenyl and alkynyl group can be branched or linear and have 2 to 20 carbon atoms. Preferred alkenyl group is allyl.

Useful heterocyclic group as $R_5$, $R_6$, $R_8$, or $R_9$ can have 5 to 10 carbon atoms, an oxygen atom, a sulfur atom, or a nitrogen atom in a center ring system and may have a condensed ring.

These alkyl, aryl, cycloalkyl, and heterocyclic groups can be further substituted by one or more groups containing a halo group, an alkoxycarbonyl group, a hydroxyl group, an alkoxy group, a cyano group, an acyl group, an acyloxy group, a carbonyloxyester group, a sufonate ester group, an alkylthio group, a dialkylamino group, a carboxyl group, a sulfo group, a phosphono group, or other group which the art can easily understand, however substituents are not limited in these.

Useful alkoxy group, alkylthio group, or arylthio group as $R_5$ has the above-mentioned alkyl group or arly group. Preferred halogen atom are chlorine and bromine atom. Representative compounds of formula (II) are the following compound II-1 to II-10. Compound II-1 is most preferable.

(II-1)

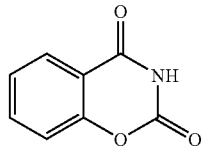

(II-2)

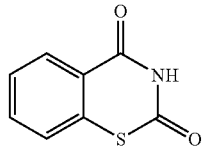

(II-3)

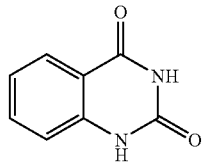

(II-4)

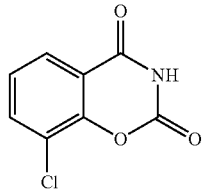

(II-5)

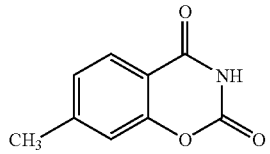

(II-6)

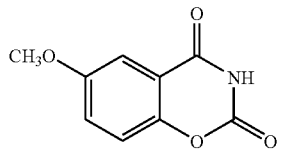

(II-7)

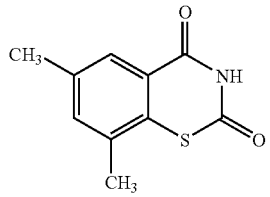

(II-8)

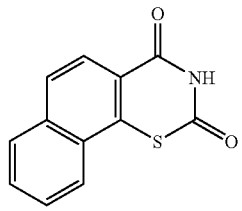

-continued (II-9)

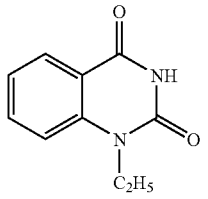

(II-10)

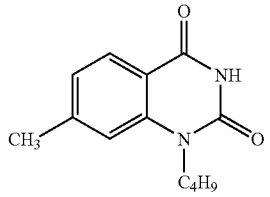

Other useful substituted benzoxazinediones are described in the specification of U.S. Pat. No. 3,951,660. These compounds of formula (I) or (II) are preferred to use as a toner. As a toner used in combination with compound of formula (I) or (II), phthalazinone, a phthalazinone derivative, or a metal salt of the derivative (e.g., 4-(1-naphthyl) phthalazinone, 6-chlorophthalazinone, 5,7-dimethoxyphthalazinone, or 2,3-dihydro-1,4-phthalazinedione); phthalazine or a phthalazine derivative (e.g., 5-isopropylphthalazine) or a phthalic acid derivative (e.g., phthalic acid, 4-methylphthalic acid, 4-nitrophthalic acid, or tetrachlorophthalic acid) may be used as a combination.

The addition amount of the compound of formula (I) or (II) in the present invention is preferably in a range of from $10^{-4}$ mol to 1 mol per 1 mol of non-photosensitive silver salt in the image forming layer, more preferably from $10^{-3}$ mol to 0.5 mol, and even more preferably from $1\times10^{-2}$ mol to 0.3 mol.

Concerning the method for incorporating the compound of formula (I) or (II) of the present invention in the photothermographic material, similar method to the case of reducing agent can be described. Water soluble compound is preferably added as an aqueous solution and water insoluble compound is preferably added as a solid fine particle dispersion.

The compound of formula (I) or (II) of the present invention is preferably added in the image forming layer or in the non-photosensitive layer disposed on the side having thereon the image forming layer such as protective layer or intermediate layer, and is more preferably added in the image forming layer.

(Plasticizer and Lubricant)

In the invention, well-known plasticizer and lubricant can be used to improve physical properties of film. Particularly, to improve handling facility during manufacturing process or scratch resistance during thermal development, it is preferred to use a lubricant such as a liquid paraffin, a long chain fatty acid, an amide of fatty acid, an ester of fatty acid, or the like.

Paticularly preferred are a liquid paraffin obtained by removing components having low boiling point and an ester of fatty acid having a branch structure and a molecular weight of 1000 or more.

As for plasticizers and lubricants usable in the image forming layer and in the non-photosensitive layer, compounds described in paragraph No. 0117 of JP-A No. 11-65021 and in JP-A Nos. 2000-5137, 2004-219794, 2004-219802, and 2004-334077 are preferable.

(Dyes and Pigments)

From the viewpoint of improving color tone, of preventing the generation of interference fringes and of preventing irradiation on laser exposure, various types of dyes and pigments (for instance, C.I. Pigment Blue 60, C.I. Pigment Blue 64, and C.I. Pigment Blue 15:6) can be used in combination with the aforementioned phthalocyanine compound in the image forming layer of the invention. Detailed description can be found in WO No. 98/36322, JP-A Nos. 10-268465 and 11-338098, and the like.

(Nucleator)

Concerning the photothermographic material of the invention, it is preferred to add a nucleator into the image forming layer. Details on the nucleators, method for their addition and addition amount can be found in paragraph No. 0118 of JP-A No. 11-65021, paragraph Nos. 0136 to 0193 of JP-A No. 11-223898, as compounds expressed by formulae (H), (1) to (3), (A), and (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, and preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, 35° C. or more and less than 60° C., and even more preferably, from 35° C. to 55° C. Furthermore, the temperature of the coating solution for the image forming layer immediately after adding the polymer latex is preferably maintained in the temperature range from 30° C. to 65° C.

(Layer Constitution and Other Constituting Components)

The photothermographic material of the invention has one or more image forming layers constructed on a support. In the case of constituting the image forming layer from one layer, the image forming layer comprises an organic silver salt, a photosensitive silver halide, a reducing agent, and a binder, and may further comprise additional materials as desired and necessary, such as an antifoggant, a toner, a film-forming promoting agent, and other auxiliary agents. In the case of constituting the image forming layer from two or more layers, the first image forming layer (in general, a layer placed nearer to the support) contains an organic silver salt and a photosensitive silver halide. Some of the other components are incorporated in the second image forming layer or in both of the layers.

The photothermographic material according to the invention has a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided to the side opposite to the image forming layer.

Furthermore, a layer that functions as an optical filter may be provided as (a) or (b) above. An antihalation layer may be provided as (c) or (d) to the photothermographic material.

1) Surface Protective Layer

The photothermographic material of the invention may further comprise a surface protective layer with an object to prevent adhesion of the image forming layer. The surface protective layer may be a single layer, or plural layers.

Description on the surface protective layer may be found in paragraph Nos. 0119 to 0120 of JP-A No. 11-65021 and in JP-A No. 2000-171936.

Preferred as the binder of the surface protective layer of the invention is gelatin, but poly(vinyl alcohol) (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105, the partially saponified PVA-205, and PVA-335, as well as modified poly(vinyl alcohol) MP-203 (all trade name of products from Kuraray Ltd.). The amount of coated poly(vinyl alcohol) (per 1 $m^2$ of support) in the surface protective layer (per one layer) is preferably in a range from 0.3 $g/m^2$ to 4.0 $g/m^2$, and more preferably, from 0.3 $g/m^2$ to 2.0 $g/m^2$.

The total amount of the coated binder (including water-soluble polymer and latex polymer) (per 1 $m^2$ of support) in the surface protective layer (per one layer) is preferably in a range from 0.3 $g/m^2$ to 5.0 $g/m^2$, and more preferably, from 0.3 $g/m^2$ to 2.0 $g/m^2$.

Further, it is preferred to use a lubricant such as a liquid paraffin and an ester of fatty acid in the surface protective layer. The addition amount of the lubricant is in a range of from 1 $mg/m^2$ to 200 $mg/m^2$, preferably 10 $mg/m^2$ to 150 $mg/m^2$ and, more preferably 20 $mg/m^2$ to 100 $mg/m^2$.

2) Antihalation Layer

The photothermographic material of the present invention can comprise an antihalation layer provided to the side farther from the light source with respect to the image forming layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case where the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used at an amount as such that the optical density (absorbance) exceeds 0.1 when measured at the desired wavelength. The optical density is preferably in a range of from 0.15 to 2, and more preferably from 0.2 to 1. The addition amount of dyes to obtain optical density in the above range is generally from 0.001 $g/m^2$ to 1 $g/m^2$.

By decoloring the dye in such a manner, the optical density after thermal development can be lowered to 0.1 or lower. Two or more types of thermal bleaching dyes may be used in combination in a photothermographic material. Similarly, two or more types of base precursors may be used in combination.

In the case of thermal decolorization by the combined use of a decoloring dye and a base precursor, it is advantageous from the viewpoint of thermal decoloring efficiency to further use a substance capable of lowering the melting point by at least 3° C. when mixed with the base precursor (e.g., diphenylsulfone, 4-chlorophenyl(phenyl)sulfone, 2-naphthylbenzoate, or the like) as disclosed in JP-A No. 11-352626.

3) Back Layer

Back layers usable in the invention are described in paragraph Nos. 0128 to 0130 of JP-A No. 11-65021.

In the invention, coloring matters having maximum absorption in the wavelength range from 300 nm to 450 nm can be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in a range of from 0.1 $mg/m^2$ to 1 $g/m^2$, preferably to the back layer which is provided on the side opposite to the image forming layer.

Further, in order to control the basic color tone, it is preferred to use a dye having an absorption peak in a wavelength range from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in the non-photosensitive layer on the image forming layer side, or in the backside.

The photothermographic material of the invention is preferably a so-called single-sided photosensitive material, which comprises at least one layer of a image forming layer containing silver halide emulsion on one side of the support, and a back layer on the other side. Further, the photothermographic material of the invention is preferably not used in the form of a roll, but in the form of a cut sheet.

4) Matting Agent

A matting agent is preferably added to the photothermographic material of the invention in order to improve transportability. Description on the matting agent can be found in paragraphs Nos. 0126 to 0127 of JP-A No. 11-65021. The addition amount of the matting agent is preferably in a range from 1 mg/m$^2$ to 400 mg/m$^2$, and more preferably, from 5 mg/m$^2$ to 300 mg/m$^2$, with respect to the coating amount per 1 m$^2$ of the photothermographic material.

The shape of the matting agent usable in the invention may fixed form or non-fixed form. Preferred is to use those having fixed form and globular shape.

Volume weighted mean equivalent spherical diameter of the matting agent used in the image forming layer surface is preferably in a range from 0.3 μm to 10 μm, and more preferably, from 0.5 μm to 7 μm. Further, the particle distribution of the matting agent is preferably set as such that the variation coefficient may become from 5% to 80%, and more preferably, from 20% to 80%. The variation coefficient, herein, is defined by (the standard deviation of particle diameter)/(mean diameter of the particle)×100.

Furthermore, two or more kinds of matting agents having different mean particle size can be used in the image forming layer surface. In this case, it is preferred that the difference between the mean particle size of the biggest matting agent and the mean particle size of the smallest matting agent is from 2 μm to 8 μm, and more preferred, from 2 μm to 6 μm.

Volume weighted mean equivalent spherical diameter of the matting agent used in the back surface is preferably in a range from 1 μm to 15 μm, and more preferably, from 3 μm to 10 μm. Further, the particle distribution of the matting agent is preferably set as such that the variation coefficient may become from 3% to 50%, and more preferably, from 5% to 30%. Furthermore, two or more kinds of matting agents having different mean particle size can be used in the back surface. In this case, it is preferred that the difference between the mean particle size of the biggest matting agent and the mean particle size of the smallest matting agent is from 2 μm to 14 μm, and more preferred, from 2 μm to 9 μm.

The level of matting on the image forming layer surface is not restricted as far as star-dust trouble occurs, but the level of matting of 30 seconds to 2000 seconds is preferred, particularly preferred, 40 seconds to 1500 seconds as Beck's smoothness. Beck's smoothness can be calculated easily, using Japan Industrial Standared (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and even more preferably, 500 seconds or less and 40 seconds or more when expressed by Beck's smoothness.

In the present invention, a matting agent is preferably contained in an outermost layer, in a layer which can function as an outermost layer, or in a layer nearer to outer surface, and also preferably is contained in a layer which can function as a so-called protective layer.

5) Polymer Latex

A polymer latex is preferably used in the surface protective layer and the back layer of the photothermographic material in the present invention. As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678.

The polymer latex in the surface protective layer is preferably contained in an amount of from 10% by weight to 90% by weight, particularly preferably from 20% by weight to 80% by weight, of the total weight of binder.

6) Surface pH

The surface pH of the photothermographic material according to the invention preferably yields a pH of 7.0 or lower, and more preferably 6.6 or lower, before thermal developing process. Although there is no particular restriction concerning the lower limit, the lower limit of pH value is about 3. The most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH.

In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener may be used in each of image forming layer, protective layer, back layer, and the like of the invention.

As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193, and the like, epoxy compounds of U.S. Pat. No. 4,791,042 and the like, and vinyl sulfone compounds of JP-A No. 62-89048.

The hardener is added as a solution, and the solution is added to a coating solution 180 minutes before coating to just before coating, preferably 60 minutes before to 10 seconds before coating. However, so long as the effect of the invention is sufficiently exhibited, there is no particular restriction concerning the mixing method and the conditions of mixing.

As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Ekitai Kongo Gijutu (Liquid Mixing Technology)" (Nikkan Kogyo Shinbunsha, 1989), and the like.

8) Surfactant

Concerning the surfactant, the solvent, the support, antistatic agent and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573 and in paragraph numbers 0049 to 0062 of JP-A No. 2001-83679.

In the invention, it is preferred to use a fluorocarbon surfacant. Specific examples of fluorocarbon surfacants can be found in those described in JP-A Nos. 10-197985, 2000-19680, and 2000-214554. Polymer fluorocarbon surfacants described in JP-A 9-281636 can be also used preferably.

For the photothermographic material in the invention, the fluorocarbon surfacants described in JP-A Nos. 2002-82411, 2003-57780, and 2001-264110 are preferably used. Especially, the usage of the fluorocarbon surfacants described in JP-A Nos. 2003-57780 and 2001-264110 in an aqueous coating solution is preferred viewed from the standpoint of capacity in static control, stability of the coated surface state and sliding facility. The fluorocarbon surfactant described in JP-A No. 2001-264110 is mostly preferred because of high capacity in static control and that it needs small amount to use.

According to the invention, the fluorocarbon surfactant can be used on either side of image forming layer side or back layer side, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably in a range of from 0.1 mg/m$^2$ to 100 mg/m$^2$ on each side of image forming layer and back layer, more preferably from 0.3 mg/m$^2$ to 30 mg/m$^2$, and even more preferably from 1 mg/m$^2$ to 10 mg/m$^2$. Especially, the fluorocarbon surfactant described in JP-A No. 2001-264110 is effective, and used preferably in a range of from 0.01 mg/m$^2$ to 10 mg/m$^2$, and more preferably from 0.1 mg/m$^2$ to 5 mg/m$^2$.

9) Antistatic Agent

The photothermographic material of the invention preferably contains an electrically conductive layer including metal oxides or electrically conductive polymers. The antistatic layer may serve as an undercoat layer, or a back surface protective layer, and the like, but can also be placed specially. As an electrically conductive material of the antistatic layer, metal oxides having enhanced electric conductivity by the method of introducing oxygen defects or different types of metallic atoms into the metal oxides are preferable for use.

Examples of metal oxides are preferably selected from ZnO, $TiO_2$, or $SnO_2$. As the combination of different types of atoms, preferred are ZnO combined with Al, or In; $SnO_2$ with Sb, Nb, P, halogen atoms, or the like; $TiO_2$ with Nb, Ta, or the like. Particularly preferred for use is $SnO_2$ combined with Sb.

The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles, with the rate of (the major axis)/(the minor axis) is 2.0 or more, and more preferably in a range of from 3.0 to 50, is preferred viewed from the standpoint of the electric conductivity effect.

The metal oxides is preferably used in a range of from 1 mg/m$^2$ to 1000 mg/m$^2$, more preferably from 10 mg/m$^2$ to 500 mg/m$^2$, and even more preferably from 20 mg/m$^2$ to 200 mg/m$^2$. The antistatic layer can be laid on either side of the image forming layer surface side or the back layer surface side, it is preferred to set between the support and the back layer.

Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

10) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored.

As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like.

The moisture content of the support is preferably 0.5% by weight or lower when coating for image forming layer and back layer is conducted on the support.

11) Other Additives

Furthermore, an antioxidant, stabilizing agent, plasticizer, UV absorbent, or film-forming promoting agent may be added to the photothermographic material. Each of the additives is added to either of the image forming layer or the non-photosensitive layer. Reference can be made to WO No. 98/36322, EP No. 803764A1, JP-A Nos. 10-186567 and 10-18568, and the like.

12) Coating Method

The photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and particularly preferably used is slide coating.

Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the image forming layer in the invention is preferably a so-called thixotropic fluid. For the details of this technology, reference can be made to JP-A No. 11-52509. Viscosity of the coating solution for the image forming layer in the invention at a shear velocity of $0.1S^{-1}$ is preferably from 400 mPa·s to 100,000 mPa·s, and more preferably, from 500 mPa·s to 20,000 mPa·s. At a shear velocity of $1000S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state.

Preferred defoaming treatment method in the invention is described in JP-A No. 2002-66431. In the case of applying the coating solution of the invention to the support, it is preferred to perform diselectrification in order to prevent the adhesion of dust, particulates, and the like due to charge up.

Preferred example of the method of diselectrification for use in the invention is described in JP-A No. 2002-143747.

Since a non-setting coating solution is used for the image forming layer in the invention, it is important to precisely control the drying wind and the drying temperature.

Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds.

A preferred method of heat treatment for the invention is described in JP-A No. 2002-107872.

Furthermore, the producing methods described in JP-A Nos. 2002-156728 and 2002-182333 are favorably used in the invention in order to stably and successively produce the photothermographic material of the invention.

The photothermographic material is preferably of monosheet type (i.e., a type which can form image on the photothermographic material without using other sheets such as an image-receiving material).

13) Wrapping Material

In order to suppress fluctuation from occurring on the photographic property during a preservation of the photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and even more preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and even more preferably, 1 $g \cdot atm^{-1}m^{-2}day^{-1}$ or lower.

As specific examples of a wrapping material having low oxygen transmittance and/or vapor transmittance, reference can be made to, for instance, the wrapping material described in JP-A Nos. 8-254793 and 2000- 206653.

14) Other Applicable Techniques

Techniques which can be used for the photothermographic material of the invention also include those in EP No. 803764A1, EP No. 883022A1, WO No. 98/36322, JP-A Nos. 56-62648, and 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, 2001-348546, and 2000-187298.

In the case of multicolor photothermographic material, each of the image forming layers is maintained distinguished from each other by incorporating functional or non-functional barrier layer between each of the image forming layers as described in U.S. Pat. No. 4,460,681.

The constitution of a multicolor photothermographic material may include combinations of two layers for those for each of the colors, or may contain all the components in a single layer as described in U.S. Pat. No. 4,708,928.

(Image Forming Method)

1) Imagewise Exposure

Although the photothermographic material of the invention may be subjected to imagewise exposure by any methods, preferred is scanning exposure using laser beam. As laser beam, He—Ne laser of red through infrared emission, red laser diode, or $Ar^+$, He—Ne, He—Cd laser of blue through green emission, or blue laser diode can be used. Preferred is red to infrared laser diode and the peak wavelength of laser beam is 600 nm to 900 nm, and preferably 620 nm to 850 nm. From the standpoint of utilizing a high power provided by the laser power and making the processed photothermographic material of the present invention transparent, an infrared laser diode (780 nm, 810 nm) is preferably employed.

In recent years, development has been made particularly on a light source module with an SHG (a second harmonic generator) and a laser diode integrated into a single piece whereby a laser output apparatus in a short wavelength region has come into the limelight. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

2) Thermal Development

Although any method may be used for this thermal developing process, development is usually performed by elevating the temperature of the photothermographic material exposed imagewise. The temperature of development is preferably from 80° C. to 250° C., more preferably from 100° C. to 140° C., and even more preferably from 110° C. to 130° C. Time period for development is preferably from 1 second to 60 seconds, more preferably from 3 seconds to 30 seconds, even more preferably from 5 seconds to 25 seconds, and particularly preferably from 7 seconds to 15 seconds. Concerning the process of thermal development, either a drum type heater or a plate type heater may be used. However, a plate type heater is preferred. In the case where a protective layer is disposed on the image forming layer, it is preferred that the surface on the side having the protective layer is sujected to heat treatment in contact with the heating means, from the viewpoint of uniform heating and enhancing the heating and operating efficiency. More preferably, the material is developed by heat treatment while contacting the surface with the heater and conveying the material.

3) System

The photothermographic material of the present invention is preferably thermally developed by an image forming apparatus equipped with a scanning exposing portion using laser beam, and thermal developing portion, in which the material is subjected to scanning exposure by laser beam and successively thermal development while conveying the material in the apparatus. The image forming apparatus is preferred for downsizing the apparatus and easy handling, and capability of connecting with various medical diagnostic instruments. Moreover, rapid image formation can be attained by subjecting the material to imagewise exposure and thermal development while conveying the material at a line speed of 23 mm/second or higher. More preferably, the material is conveyed at a line speed of 28 mm/second or higher.

Examples of a medical laser imager equipped with a light exposing portion and a thermal developing portion include Fuji Medical Dry Laser Imager FM-DPL and DRYPIX 7000, and KODAK DRYVIEW 8700 Laser Imager Plus can be applied. In connection with FM-DPL, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The photothermographic material of the invention is preferably used for photothermographic materials for use in medical diagnosis, photothermographic materials for use in industrial photographs, photothermographic materials for use in graphic arts, as well as for COM, through forming black and white images by silver imaging. In particular, the photothermographic material of the invention is preferably used for photothermographic materials for use in medical diagnosis.

EXAMPLES

The present invention is specifically explained by way of Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

3) Undercoating

| | | |
|---|---|---|
| Formula (1) (for undercoat layer on the image forming layer side) | | |
| Pesresin A-520 manufactured by Takamatsu Oil & Fat Co., Ltd. (30% by weight solution) | 46.8 | g |
| BAIRONAARU MD-1200 manufactured by Toyo Boseki Co., Ltd. | 10.4 | g |
| Polyethyleneglycol monononylphenylether (average ethylene oxide number = 8.5) 1% by weight solution | 11.0 | g |
| MP-1000 manufactured by Soken Chemical & Engineering Co., Ltd. (polymer fine particle, mean particle diameter of 0.4 μm) | 0.91 | g |
| Distilled water | 931 | mL |
| Formula (2) (for first layer on the backside) | | |
| Styrene-butadiene copolymer latex (solid content of 40% by weight, styrene/butadiene mass ratio = 68/32) | 130.8 | g |
| Sodium salt of 2,4-dichloro-6-hydroxy-S-triazine (8% by weight aqueous solution) | 5.2 | g |
| 1% by weight aqueous solution of sodium laurylbenzenesulfonate | 10 | mL |
| Polystyrene particle dispersion (mean particle diameter of 2 μm, 20% by weight) | 0.5 | g |
| Distilled water | 854 | mL |
| Formula (3) (for second layer on the backside) | | |
| $SnO_2$/SbO (9/1 mass ratio, mean particle diameter of 0.5 μm, 17% by weight dispersion) | 84 | g |
| Gelatin | 7.9 | g |
| METOLOSE TC-5 manufactured by Shin-Etsu Chemical Co., Ltd. (2% by weight aqueous solution) | 10 | g |
| 1% by weight aqueous solution of sodium dodecylbenzenesulfonate | 10 | mL |
| NaOH (1% by weight) | 7 | g |
| Proxel (manufactured by Imperial Chemical Industries PLC) | 0.5 | g |
| Distilled water | 881 | mL |

Both surfaces of the biaxially tentered polyethylene terephthalate support having the thickness of 175 μm were subjected to the corona discharge treatment as described above, respectively. Thereafter, the aforementioned formula (1) of the coating solution for the undercoat was coated on one surface (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/m$^2$, and dried at 180° C. for 5 minutes. Furthermore, the aforementioned formula (3) of the coating solution for the undercoat was coated on the reverse side (backside) with a wire bar so that the amount of wet coating became 8.4 mL/m$^2$, and dried at 180° C. for 6 minutes. Thus, an undercoated support was produced.

(Back Layer)

1) Preparation of Coating Solution for Back Layer

<Preparation of Dispersion of Solid Fine Particles (a) of Base Precursor>

2.5 kg of base precursor-1, 300 g of a surfactant (trade name: DEMOL N, manufactured by Kao Corporation), 800 g of diphenylsulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). Process of dispersion includs feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

Dispersion was continued until the ratio of the optical density at 450 nm to the optical density at 650 nm for the spectral absorption of the dispersion ($D_{450}/D_{650}$) became 3.0 upon spectral absorption measurement. Thus resulting dispersion was diluted with distilled water so that the concentration of the base precursor becomes 25% by weight, and filtrated (with a polypropylene filter having a mean fine pore diameter of 3 μm) for eliminating dust to put into practical use.

2) Preparation of Solid Fine Particle Dispersion of Dye

Cyanine dye-1 in an amount of 6.0 kg, 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total amount of 60 kg. The mixed liquid was subjected to dispersion with 0.5 mm zirconia beads using a horizontal sand mill (UVM-2: manufactured by AIMEX Co., Ltd.).

Dispersion was continued until the ratio of the optical density at 650 nm to the optical density at 750 nm for the spectral absorption of the dispersion ($D_{650}/D_{750}$) becomes 5.0 or higher upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

3) Preparation of Coating Solution for Antihalation Layer

A vessel was kept at 40° C., and thereto were added 37 g of gelatin having an isoelectric point of 6.6 (ABA gelatin, manufactured by Nippi Co., Ltd.), 0.1 g of benzoisothiazolinone, and water to allow gelatin to be dissolved. Additionally, 36 g of the above-mentioned dispersion of the solid fine particles of the dye, 73 g of the above-mentioned dispersion of the solid fine particles (a) of the base precursor, 43 mL of a 3% by weight aqueous solution of sodium polystyrenesulfonate, and 82 g of a 10% by weight solution of SBR latex (styrene/butadiene/acrylic acid copolymer; mass ratio of the copolymerization of 68.3/28.7/3.0) were admixed to give a coating solution for the antihalation layer in an amount of 773 mL. The pH of the coating solution was 6.3.

4) Preparation of Coating Solution for Back Surface Protective Layer

A vessel was kept at 40° C., and thereto were added 43 g of gelatin having an isoelectric point of 4.8 (PZ gelatin, manufactured by Miyagi Chemical Industry Co., Ltd.), 0.21 g of benzoisothiazolinone, and water to allow gelatin to be dissolved.

Additionally, 8.1 mL of a 1 mol/L sodium acetate aqueous solution, 0.93 g of monodispersed fine particles of poly (ethylene glycol dimethacrylate-co-methylmethacrylate) (mean particle diameter of 7.7 μm, standard deviation of particle diameter of 0.3), 5 g of a 10% by weight emulsion of liquid paraffin, 10 g of a 10% by weight emulsion of dipentaerythritol hexaisostearate, 10 mL of a 5% by weight aqueous solution of di(2-ethylhexyl) sodium sulfosuccinate, 17 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 30 mL of a 20% by weight solution of ethyl acrylate/acrylic acid copolymer (mass ratio of the copolymerization of 96.4/3.6) latex were admixed.

Just prior to the coating, 50 mL of a 4% by weight aqueous solution of N,N-ethylenebis(vinylsulfone acetamide) was admixed to give a coating solution for the back surface protective layer in an amount of 855 mL. The pH of the coating solution was 6.2.

5) Coating of Back Layer

The back side of the undercoated support described above was subjected to simultaneous double coating so that the coating solution for the antihalation layer gave the coating amount of gelatin of 0.54 g/m$^2$, and so that the coating solution for the back surface protective layer gave the coating amount of gelatin of 1.85 g/m$^2$, followed by drying to produce a back layer.

(Image Forming Layer and Surface Protective Layer)

1. Preparations of Coating Material

1) Preparation of Silver Halide Emulsion

<<Preparation of Silver Halide Emulsion 1>>

A liquid was prepared by adding 3.1 mL of a 1% by weight potassium bromide solution, and then 3.5 mL of 0.5 mol/L sulfuric acid and 31.7 g of phthalated gelatin to 1421 mL of distilled water. The liquid was kept at 30° C. while stirring in a stainless steel reaction vessel, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes.

Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide dispersion 2 was conducted in a similar manner to the process in the preparation of the silver halide emulsion 1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted; further the precipitation/desalting/water washing/dispersion were carried out similar to the silver halide emulsion 1. Furthermore, the spectral sensitization, chemical sensitization, and addition of 5-methyl-2-mercaptobenzimidazole and 1-phenyl-2-heptyl-5-mercapto-1,3,4-triazole were executed to the silver halide dispersion 2 similar to the silver halide emulsion 1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion 2. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide dispersion 3 was conducted in a similar manner to the process in the preparation of the silver halide emulsion 1 except that the temperature of the liquid upon the grain forming process was altered from 30° C. to 27° C., and in addition, the precipitation/desalting/water washing/dispersion were carried out similarly to the silver halide emulsion 1. Silver halide emulsion 3 was obtained similarly to the silver halide emulsion 1 except that: to the silver halide dispersion 3, the addition of the methanol solution of the spectral sensitizing dye A and the spectral sensitizing dye B was changed to the solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the amount of the tellurium sensitizer C to be added was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver.

Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

2) Preparation of Dispersion of Silver Salt of Fatty Acid

<<Preparation of Recrystallized Behenic Acid>>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour.

The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<<Preparation of Nano-particles of Silver Behenate>>

Into a reaction vessel, deionized water, 72 g of a 10% by weight aqueous solution of dodecylthio polyacrylamide surfactant (BUN-1), and 46.6 g of the above recrystallized behenic acid were added. The mixture was stirred at a rotating speed of 150 rpm and heated to 70° C., while adding 70.6 g of a 10% by weight aqueous solution of potassium hydroxide into the reaction vessel.

Next, the resulting mixture was heated to 80° C. and allowed to stand for 30 minutes till the solution turned to be turbid. Thereafter, the mixture was cooled to 70° C. and then 21.3 g of 100% by weight solution of silver nitrate was added into the reaction vessel over a period of 30 minutes while adjusting the addition speed. The reaction temperature of the mixture was kept for 30 minutes and then cooled to room temperature, and the resultant was then decanted. The nano-particle dispersion of silver behenate having a median particle size of 150 nm was obtained (solid content: 3% by weight).

<<Purification and Condensation of Nano-Particles of Silver Behenate>>

12 kg of nano-particle dispersion (solid content: 3% by weight) was introduced into a filtration dialysis/ultrafiltration device equipped with a permeable membrane cartridge Osmonics Model 21-HZ20-S8J (the effective surface area: 0.34 $m^2$, nominal molecular weight cutoff of 50,000).

The device was operated so that the pressure to the permeable membrane was set to be 3.5 kg/$cm^2$ (50 lb/in 2), and the pressure of the downstream side of the permeable membrane was set to be 20 kg/$cm^2$ (285 lb/$in^2$). The permeating liquid was replaced by deionized water until 24 kg of permeating liquid was removed from the dispersion, and then the replacement by deionized water was stopped. Thereafter, the device was operated until the dispersion reached to a concentration of 28% by weight based on the solid content. Thereby, purified and condensed nano-particle dispersion of silver behenate was obtained.

3) Preparation of Reducing Agent Dispersion

<<Preparation of Reducing Agent-1 Dispersion>>

To 10 kg of reducing agent-1 (2,2'-(3,5,5-trimethylhexylidene) bis(4,6-dimethylphenol)) and 16 kg of a 10% by weight aqueous solution of modified poly(vinyl alcohol) (manufactured by Kuraray Co., Ltd., Poval MP-203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzoisothiazolinone sodium salt and water were added thereto, thereby adjusting the concentration of the reducing agent to be 25% by weight.

This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less.

The resultant reducing agent dispersion was subjected to filtration with a polypropylene filter having a pore size of 3.0 μm to remove foreign substances such as dust, and stored.

<<Preparations of Other Reducing Agent Dispersion>>

The reducing agent dispersions shown in Table 1 were prepared in a similar manner to the process in the preparation of reducing agent-1 dispersion.

4) Preparations of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less.

The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give a slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight.

This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less.

The resultant organic polyhalogen compound dispersion was subjected to filtration with a polypropylene filter having a pore size of 3.0 μm to remove foreign substances such as dust, and stored.

5) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having a mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain a pigment-1 dispersion.

Particles of the pigment included in the resulting pigment dispersion had a mean particle diameter of 0.21 μm.

6) Preparation of 4-Methyl Phthalic Acid Aqueous Solution

A 5% by weight aqueous solution of 4-methylphthalic acid was prepared.

7) Preparation of Compound of Formula (I) or (II)

A water-soluble compound ws added as an aqueous solution thereof, and a water-insoluble compound ws added as a dispersion prepared by the process described below.

<<Preparation of Dispersion of Compound of Formula (I) or (II)>>

60 g of the compound represented by formula (I) or (II), 120 g of a 10% by weight aqueous solution of modified poly(vinyl alcohol) (manufactured by Kuraray Co., Ltd., Poval MP203) and 120 g of water were thoroughly admixed to give a slurry. Zirconia silcate beads having a mean particle diameter of 0.5 mm were provided in an amount of 720 g, and charged in a vessel with the slurry. Dispersion was performed with a dispersing machine (1/4G sand grinder mill: manufactured by AIMEX Co., Ltd.) for 15 hours. Thereto was added water to adjust so that the concentration of the pigment became 15% by weight to obtain a dispersion.

2. Preparations of Coating Solution

1) Preparation of Coating Solution for Image Forming Layer

A vessel was kept at 40° C., and thereto were added 450 mL of water and 200 g of gelatin. After dissolving the gelatin, the dispersion of silver salt of fatty acid obtained as described above, the pigment-1 dispersion, the organic polyhalogen compound-1 dispersion, the organic polyhalogen compound-2 dispersion, the compound of formula (I) or (II) (shown in Table 1), the reducing agent dispersion (shown in Table 1), the 4-methylphthalic acid aqueous solution, and sodium iodide were serially added. The mixed emulsion A for coating solution was added thereto, followed by thorough mixing just prior to the coating, which is fed directly to a coating die.

The amount of zirconium in the coating solution was 0.18 mg per 1 g of silver.

2) Preparation of Coating Solution for Surface Protective Layer

A vessel was kept at 40° C., and thereto were added 2400 mL of water and 300 g of gelatin. After dissolving the gelatin, 60 g of a 5% by weight aqueous solution of di(2-ethylhexyl) sodium sulfosuccinate, and 900 g of succinimide aqueous solution were serially added and then stirred well to prepare a coating solution.

3. Preparation of Photothermographic Material

Reverse surface of the back surface on which the back layer was coated was subjected to simultaneous overlaying coating by a slide bead coating method in order of the image forming layer and surface protective layer, and thus sample of photothermographic material was produced. In this method, the temperature of the coating solution was adjusted to 37° C. for the image forming layer and surface protective layer.

The coating amount of each compound (g/m$^2$) for the image forming layer is as follows. The surface protective layer was coated to give the coating amount of dry gelatin of 2.0 g/m$^2$.

| | |
|---|---|
| Silver salt of fatty acid | 5.42 |
| Pigment (C.I.Pigment Blue 60) | 0.036 |
| Organic polyhalogen compound-1 | 0.10 |
| Organic polyhalogen compound-2 | 0.34 |
| 4-Methyl phthalic acid | 0.08 |
| Compound of formula (I) or (II) | (see Table 1) |
| Binder (the kind is shown in Table 1) | 3.90 |
| Sodium iodide | 0.04 |

-continued

| | |
|---|---|
| Reducing agent | (see Table 1) |
| Silver halide (on the basis of Ag content) | 0.10 |

Chemical structures of the compounds used in Examples of the invention are shown below.

(F-1)

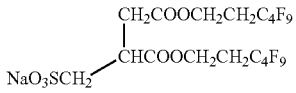

(F-2)

Mixture of

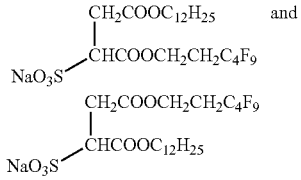

Spectral sensitizing dye A

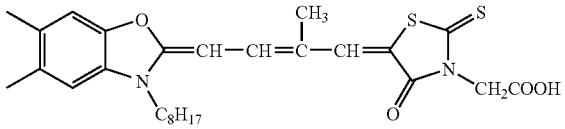

Spectral sensitizing dye B

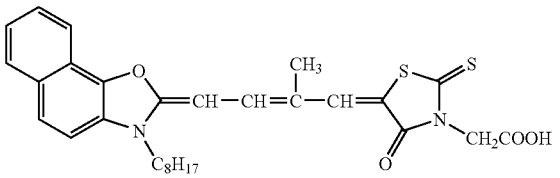

Base precursor-1

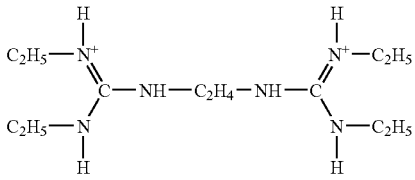

Cyanine dye-1

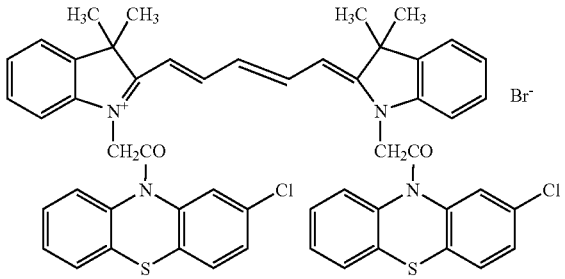

compound-1

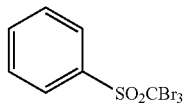

Organic polyhalogen

-continued compound-2

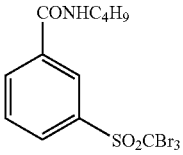

Organic polyhalogen

Reducing agent-1

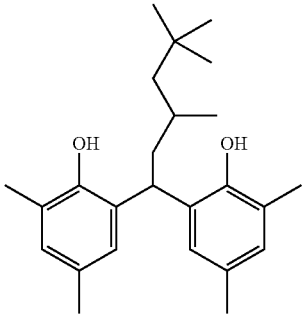

Reducing agent-2

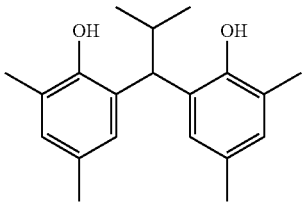

3. Evaluation of Photographic Properties

1) Preparation

The obtained sample was cut into a half-cut size (43 cm in length×35 cm in width), and was wrapped with the following packaging material under an environment of 25° C. and 50% RH, and stored for 2 weeks at an ambient temperature.

<<Packaging Material>>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$;

vapor permeability at 25° C.: 0.10 $g \cdot atm^{-1}m^{-2}day^{-1}$;

2) Exposure and Thermal Development

Scanning exposure was performed using Fuji Medical Dry Laser Imager FM-DP L (equipped with 660 nm laser diode having a maximum output of 60 mW (IIIB)) and successively thermal development (24 seconds in total with 4 panel heaters set to 112° C.–119° C.–121° C.–121° C.) was performed. Evaluation on the obtained image was performed using a densitometer.

3) Terms for Evaluation

Fog: Fog is expressed in terms of an optical density of the unexposed portion.

Dmax: Dmax is a saturated maximum density obtained with increasing the exposure value.

(Image Surface State)

Each sample of half size was subjected to exposure by laser beam for giving a density of 1.2 and thermal development in a similar condition to that in the evaluation for photographic properties. Developed samples with an uniform density were obtained and thereby the following sensory evaluation was performed according to the following criteria.

◎: Excellent surface state.

○: Slightly unevenness is seen but practically allowable level.

Δ: Periodical unevenness is seen in overall image surface, and unallowable level.

X: Definite unevenness is seen in overall surface and also coating streak is seen.

4) Result

The obtained results are shown in Table.1

The samples of the present invention attain an excellent result in image surface state when similar degree of photographic properties (fog and Dmax) is obtained. When the compound represented by formula (I) or (II) of the present invention is used with gelatin binder, excellent photographic properties are obtained, but improvement in image surface state is needed. It is assumed that the coated surface state may have some relation with the image surface state, but the cause-and-effect relationship between the coated surface state and the components of the present invention is not clear. It is assumed that one cause for the improvement in image surface state is that the addition amount of the reducing agent can be decreased by the use of the reducing agent of the present invention, and thereby the interaction between the other components is depressed.

TABLE 1

| Sample | Binder for Image Forming Layer | | Compound of Formula (I) or (II) | | Reducing Agent | | Image Surface | Photographic Properties | | |
|---|---|---|---|---|---|---|---|---|---|---|
| | | Ratio of | | | | | | | | |
| No. | Kind | Organic Silver Salt/Binder | Compound's Name | Addition Amount ($mol/m^2$) | Compound No. | Addition Amount ($mol/m^2$) | State | Fog | Dmax | Note |
| 1 | Gelatin | 1.39 | Succinimide | $2 \times 10^{-3}$ | Reducing agent-1 | $4 \times 10^{-3}$ | X | 0.23 | 3.3 | Comparative |
| 2 | Gelatin | 1.39 | Succinimide | $2 \times 10^{-3}$ | R1-3 | $2.4 \times 10^{-3}$ | ○ | 0.22 | 3.4 | Invention |
| 3 | Gelatin | 1.39 | Succinimide | $2 \times 10^{-3}$ | R1-1 | $2.4 \times 10^{-3}$ | ○ | 0.23 | 3.5 | Invention |
| 4 | Gelatin | 1.39 | Succinimide | $2 \times 10^{-3}$ | Reducing agent-2 | $4 \times 10^{-3}$ | X | 0.23 | 3.4 | Comparative |
| 5 | Gelatin | 1.39 | II-1 | $2 \times 10^{-3}$ | R1-3 | $2.4 \times 10^{-3}$ | ○ | 0.22 | 3.3 | Invention |

Example 2

Samples were prepared similar to the photothermographic material used in Example 1 except that: the kind and addition amount of binder for the image forming layer were changed and additionally a development accelerator (the kind and addition amount are shown in Table 2) was added. The prepared sample was subjected to thermal development while changing time period for development with adjusting the line speed of the thermal developing apparatus, and then similar evaluation to that in Example 1 was performed. Further, instead of using SBR used for the image forming layer, Laxster 3307B (trade name, available from Dainippon Ink and Chemical Inc.) was employed. The development accelerator used was added as a solid dispersion prepared similar to that of reducing agent-1. The conditions and results for each experiment are shown in Table 2.

From the results shown in Table 2, it is revealed that the image surface state is worsened at a high line speed and short time period for development, but the addition of the development accelerator can improve the surface state. It is revealed that the line speed of imagewise exposure and thermal development affects the image surface state as well as the coated surface state, and moreover, the use of the development accelerator has an unexpected effect on improvement in image surface state.

Furthermore, so long as the ratio of organic silver salt to the binder is in a preferred range of the present invention, photographic properties and surface state can be compatible, and thereby results are in the preferred practice of the present invention.

What is claimed is:

1. A photothermographic material comprising, on at least one side of a support, an image forming layer comprising at least a photosensitive silver halide, a non-photosensitive organic silver salt, a reducing agent, and a binder, and a non-photosensitive layer, wherein 1) the binder is a hydrophilic binder;

2) the non-photosensitive layer comprises gelatin or a gelatin derivative;

3) the reducing agent is a compound represented by the following formula (R); and 4) the photothermographic material comprises at least one compound represented by the following formula (I) or (II):

Formula (R)

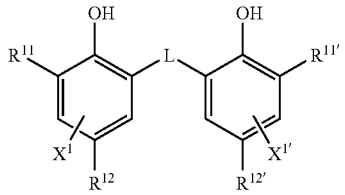

wherein in formula (R), $R^{11}$ and $R^{11'}$ each independently represent an alkyl group and at least one of $R^{11}$ and $R^{11'}$ is a secondary or tertiary alkyl group; $R^{12}$ and $R^{12'}$ each independently represent a hydrogen atom or a group capable of substituting for a hydrogen atom on a benzene ring; L represents an —S- group or a —$CHR^{13}$- group, wherein $R^{13}$ represents a hydrogen atom or an alkyl group; and $X^1$ and $X^{1'}$ each independently represent a hydrogen atom or a group capable of substituting for a hydrogen atom on a benzene ring;

TABLE 2

| Experiment No. | Binder for Image Forming Layer: Kind | Ratio of Organic Silver Salt/Binder | Compound of Formula (I) or (II): Compound's Name | Compound of Formula (I) or (II): Addition Amount (mol/m²) | Development Accelerator: Compound No. | Development Accelerator: Addition Amount (mol/m²) | Reducing Agent: Compound No. | Reducing Agent: Addition Amount (mol/m²) | Line Speed during Thermal Development (mm/sec) | Image Surface State | Photographic Properties: Fog | Photographic Properties: Dmax | Note |
|---|---|---|---|---|---|---|---|---|---|---|---|---|---|
| 201 | Gelatin | 1.39 | Succinimide | $2 \times 10^{-3}$ | — | — | Reducing agent-1 | $4 \times 10^{-3}$ | 17.1 | X | 0.23 | 3.3 | Comparative |
| 202 | Gelatin | 1.39 | Succinimide | $2 \times 10^{-3}$ | — | — | Reducing agent-1 | $4 \times 10^{-3}$ | 28.6 | X | 0.20 | 2.5 | Comparative |
| 203 | Gelatin | 1.39 | Succinimide | $2 \times 10^{-3}$ | — | — | R1-3 | $2.4 \times 10^{-3}$ | 17.1 | ○ | 0.22 | 3.4 | Invention |
| 204 | Gelatin | 1.39 | Succinimide | $2 \times 10^{-3}$ | — | — | R1-3 | $2.4 \times 10^{-3}$ | 28.6 | Δ | 0.20 | 2.5 | Invention |
| 205 | Gelatin | 1.39 | Succinimide | $2 \times 10^{-3}$ | A-7 | $6 \times 10^{-5}$ | R1-3 | $2.4 \times 10^{-3}$ | 28.6 | ◎ | 0.22 | 3.4 | Preferable Invention |
| 206 | Gelatin | 1.39 | Succinimide | $2 \times 10^{-3}$ | A-7 | $6 \times 10^{-5}$ | Reducing agent-1 | $4 \times 10^{-3}$ | 28.6 | X | 0.22 | 3.3 | Comparative |
| 207 | SBR | 1.39 | Succinimide | $2 \times 10^{-3}$ | A-7 | $6 \times 10^{-5}$ | R1-3 | $2.4 \times 10^{-3}$ | 28.6 | Δ | 0.20 | 2.8 | Comparative |
| 208 | Gelatin | 0.8 | Succinimide | $2 \times 10^{-3}$ | A-7 | $6 \times 10^{-5}$ | R1-3 | $2.4 \times 10^{-3}$ | 28.6 | ○ | 0.18 | 2.5 | Invention |
| 209 | Gelatin | 1.8 | Succinimide | $2 \times 10^{-3}$ | A-7 | $6 \times 10^{-5}$ | R1-3 | $2.4 \times 10^{-3}$ | 28.6 | ◎ | 0.22 | 3.8 | Preferable Invention |
| 210 | Gelatin | 2.6 | Succinimide | $2 \times 10^{-3}$ | A-7 | $6 \times 10^{-5}$ | R1-3 | $2.4 \times 10^{-3}$ | 28.6 | Δ | 0.32 | 3.8 | Invention |

Formula (I)

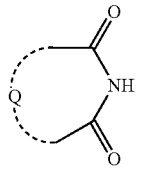

wherein in formula (I), Q represents an atomic group necessary for forming a 5- or 6-membered imide ring; and Formula (II)

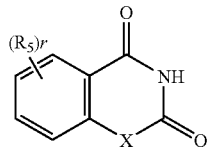

wherein in formula (II), $R_5$ independently represents one selected from a hydrogen atom, an alkyl group, a cycloalkyl group, an alkoxy group, an alkylthio group, an arylthio group, a hydroxyl group, a halogen atom, or an $N(R_8R_9)$ group, wherein $R_8$ and $R_9$ independently represent one selected from a hydrogen atom, an alkyl group, an aryl group, a cycloalkyl group, an alkenyl group, or a heterocyclic group; r represents 0, 1, 2, 3, or 4; $R_8$ and $R_9$ may link together to form a substituted or unsubstituted 5 to 7-membered heterocycle; two $R_5$'s may link together to form an aromatic, heteroaromatic, alicyclic, or heterocyclic condensed ring; and X represents one selected from O, S, Se, or $N(R_6)$, wherein $R_6$ represents one selected from a hydrogen atom, an alkyl group, an aryl group, a cycloalkyl group, an alkenyl group, or a heterocyclic group.

2. The photothermographic material according to claim 1, wherein the compound represented by formula (I) is one selected from the group consisting of uracil, 5-bromouracil, 4-methyluracil, 5-methyluracil, 4-carboxyuracil, 4,5-dimethyluracil, 5-aminouracil, dihydrouracil, 1-ethyl-6-methyluracil, 5-carboxymethylaminouracil, barbituric acid, 5-phenylbarbituric acid, cyanuric acid, urazole, hydantoin, 5,5-dimethylhydantoin, glutarimide, glutaconimide, citrazinic acid, succinimide, 3,4-dimethylsuccinimide, maleimide, phthalimide, and naphthalimide.

3. The photothermographic material according to claim 1, wherein the compound represented by formula (I) is one selected from the group consisting of succinimide, phthalimide, naphthalimide, and 3,4-dimethylsuccinimide.

4. The photothermographic material according to claim 1, wherein the compound represented by formula (I) is succinimide.

5. The photothermographic material according to claim 1, wherein the compound represented by formula (II) is at least one compound selected from the group consisting of the following compounds (II-1) to (II-10).

(II-1)

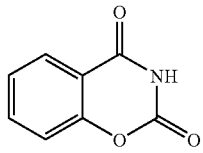

(II-2)

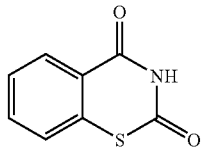

(II-3)

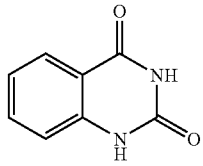

(II-4)

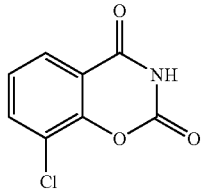

(II-5)

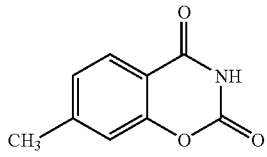

(II-6)

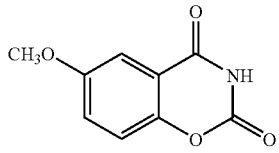

(II-7)

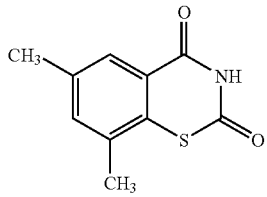

(II-8)

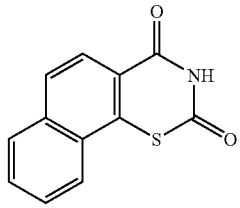

-continued (II-9)

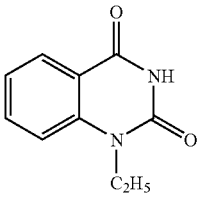

(II-10)

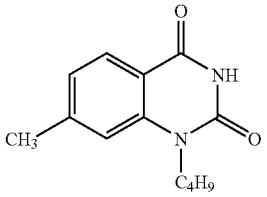

6. The photothermographic material according to claim 1, wherein the compound represented by formula (II) is the following compound.

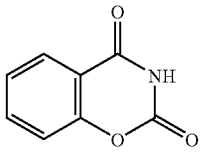

7. The photothermographic material according to claim 1, wherein the non-photosensitive organic silver salt is a silver salt of fatty acid prepared in the presence of at least one compound selected from among polyacrylamide and derivatives thereof.

8. The photothermographic material according to claim 7, wherein 40 mol % or more of the silver salt of fatty acid is silver behenate.

9. The photothermographic material according to claim 1, wherein a mass ratio of the non-photosensitive organic silver salt relative to the binder in the image forming layer is in a range of from 1.0 to 2.5.

10. The photothermographic material according to claim 1, further comprising a development accelerator.

11. An image forming method comprising: successively imagewise exposing and thermal developing the photothermographic material according to claim 1 at a line speed of 23 mm/second or higher.

* * * * *